US008696053B2

(12) United States Patent
LaPointe

(10) Patent No.: US 8,696,053 B2
(45) **Date of Patent: *Apr. 15, 2014**

(54) FURNITURE MEMBER HAVING POWERED ROCKING MOTION

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 482 days.

This patent is subject to a terminal disclaimer.

(21) Appl. No.: 13/076,479

(22) Filed: Mar. 31, 2011

(65) Prior Publication Data

US 2011/0248535 A1 Oct. 13, 2011

Related U.S. Application Data

(63) Continuation-in-part of application No. 12/759,184, filed on Apr. 13, 2010, now Pat. No. 8,459,732.

(51) Int. Cl.
*A47C 1/031* (2006.01)

(52) U.S. Cl.
USPC ..... 297/85 M; 297/330

(58) Field of Classification Search
USPC ..... 297/85 M, 330
See application file for complete search history.

(56) References Cited

U.S. PATENT DOCUMENTS

| | | | | |
|---|---|---|---|---|
| 3,138,402 | A | 6/1964 | Heyl, Jr. et al. | |
| 3,338,632 | A | 8/1967 | Kleinsorge | |
| 3,343,871 | A | 9/1967 | Yates et al. | |
| 3,588,170 | A | 6/1971 | Knabusch et al. | |
| 3,758,156 | A * | 9/1973 | Zawadzki | 297/260.2 X |
| 4,007,960 | A | 2/1977 | Gaffney | |
| 4,386,803 | A | 6/1983 | Gilderbloom | |
| 4,637,652 | A | 1/1987 | Bergenwall | |
| 4,722,566 | A | 2/1988 | Castellini | |
| 4,852,939 | A | 8/1989 | Krauska | |
| 4,993,777 | A | 2/1991 | LaPointe | |
| 5,024,486 | A | 6/1991 | Auel | |
| 5,061,010 | A | 10/1991 | LaPointe | |
| 5,165,753 | A | 11/1992 | Henderson | |
| 5,215,351 | A | 6/1993 | LaPointe | |
| 5,288,126 | A | 2/1994 | Saul et al. | |
| 5,312,153 | A | 5/1994 | Lin | |
| 5,314,238 | A | 5/1994 | Komorowski et al. | |
| 5,466,046 | A | 11/1995 | Komorowski et al. | |
| 5,482,350 | A | 1/1996 | Komorowski et al. | |

(Continued)

FOREIGN PATENT DOCUMENTS

| | | |
|---|---|---|
| DE | 29812763 | 9/1998 |
| EP | 0218502 | 4/1987 |

(Continued)

*Primary Examiner* — Anthony D Barfield
(74) *Attorney, Agent, or Firm* — Harness, Dickey & Pierce, P.L.C.

(57) ABSTRACT

A furniture member having powered rocking motion includes a frame and an actuation mechanism rotatably connected to the frame and movable in forward and rearward rocking motions with respect to the frame. A powered rocking drive device includes a motor connected to the actuation mechanism and a solenoid. The solenoid when energized releasably couples the motor to the frame such that operation of the motor automatically induces the forward and rearward rocking motions of the actuation mechanism. The solenoid when de-energized decouples the motor from the frame permitting an occupant to induce the forward and rearward rocking motions of the actuation mechanism with respect to the frame.

27 Claims, 28 Drawing Sheets

(56) References Cited

U.S. PATENT DOCUMENTS

| | | | | |
|---|---|---|---|---|
| 5,651,580 | A | 7/1997 | LaPointe et al. | |
| 5,730,494 | A | 3/1998 | LaPointe et al. | |
| 5,806,920 | A | 9/1998 | Blount | |
| 5,823,621 | A | 10/1998 | Broadhead | |
| 5,992,931 | A | 11/1999 | LaPointe et al. | |
| 6,557,940 | B2 | 5/2003 | Hayashi et al. | |
| 6,871,910 | B2 | 3/2005 | Hale | |
| 7,090,297 | B2 | 8/2006 | Mohn et al. | |
| 7,997,644 | B2 * | 8/2011 | Hoffman et al. | 297/85 M X |
| 2002/0125751 | A1 | 9/2002 | Bullard | |
| 2007/0132292 | A1 | 6/2007 | Robertson | |

FOREIGN PATENT DOCUMENTS

| | | |
|---|---|---|
| GB | 1123441 | 8/1968 |
| GB | 1497973 | 1/1978 |
| GB | 2380399 | 4/2003 |
| GB | 2436474 | 9/2007 |
| GB | 2436475 | 9/2007 |
| GB | 2436749 | 10/2007 |

* cited by examiner

FURNITURE MEMBER HAVING POWERED ROCKING MOTION

CROSS-REFERENCE TO RELATED APPLICATIONS

This application is a continuation-in-part of U.S. patent application Ser. No. 12/759,184 filed on Apr. 13, 2010. The entire disclosure of the above application is incorporated herein by reference.

FIELD

The present disclosure relates to furniture member operating mechanisms and to a device and method for operating a reclining furniture member mechanism.

BACKGROUND

This section provides background information related to the present disclosure which is not necessarily prior art.

Conventionally, reclining articles of furniture (i.e., chairs, sofas, loveseats, and the like) require a mechanism to bias a leg rest assembly in the extended and stowed positions. Known mechanisms commonly include a large number of moving parts that tends to increase the manufacturing time and costs associated with the furniture.

Most reclining rocking chairs include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly. Disadvantages of known mechanisms for providing these functions include a large quantity of parts and their requirement of one or several spring biasing elements to permit retraction of the various chair components from their extended positions.

As an additional comfort feature, a latching mechanism may also be provided for releasably retaining the chair frame in one or more rearwardly rocked or "tilted" positions on the base assembly following extension of the leg rest assembly towards its extended position. In this manner, normal "rocking" action of the rocking chair is inhibited until the leg rest assembly is returned to its normally "stowed" position. Known leg rest mechanisms also provide multiple functional positions, which can be reached using a detente mechanism, which temporarily holds the leg rest at each successive position.

SUMMARY

This section provides a general summary of the disclosure, and is not a comprehensive disclosure of its full scope or all of its features.

According to several embodiments, a rocking furniture member having an electrically powered actuation mechanism includes a frame. An actuation mechanism is connected to the frame, the actuation mechanism including an extendable and retractable leg rest assembly. An electrically powered drive assembly is connected to the actuation mechanism operating to move the leg rest assembly between retracted and extended positions. A rotation member is positioned between the actuation mechanism and the frame permitting an occupant induced rocking motion of the actuation mechanism with respect to the frame at least when the leg rest assembly is in the retracted position.

According to additional embodiments, a rocking furniture member having an electrically powered actuation mechanism includes a frame and an actuation mechanism connected to the frame. The actuation mechanism includes an extendable and retractable leg rest assembly. A drive assembly connected to the actuation mechanism having an electric motor operates to move the leg rest assembly between a retracted position and any of a plurality of extended positions inclusive including a fully extended position by a command provided by an occupant of the furniture member. A rotation member connecting the actuation mechanism to the frame permits an occupant induced rocking motion of the actuation mechanism with respect to the frame at least when the leg rest assembly is in the retracted position.

According to still further embodiments, a rocking furniture member having an actuation mechanism includes a frame and an actuation mechanism connected to the frame. The actuation mechanism includes a leg rest assembly movable between a fully retracted and a plurality of extended positions inclusive, including a fully extended position. A pantograph link of the leg rest assembly is rotatably connected to the mechanism. The pantograph link includes an engagement slot. An engagement pin is connected to an extension link. The engagement pin is releasably received in the engagement slot to extend and retract the pantograph link and thereby the leg rest assembly when the extension link is displaced. When an obstruction item in a return path of the leg rest assembly returning toward the fully retracted position is contacted, an orientation of the engagement slot permits release of the engagement pin from the engagement slot allowing the leg rest assembly to return by gravity toward the fully retracted position after removal of the obstruction item from the return path. A rotation member connects the actuation mechanism to the frame permitting an occupant induced rocking motion of the actuation mechanism with respect to the frame at least when the leg rest assembly is in the retracted position.

According to yet further embodiments a rocking furniture member includes an actuation mechanism including an extendable and retractable leg rest assembly. An electrically powered and occupant controlled drive assembly connected to the actuation mechanism operates upon receipt of a command from an occupant to move the leg rest assembly between a retracted position and any of a plurality of extended positions inclusive including a fully extended position. A pantograph link of the leg rest assembly is rotatably connected to the mechanism. The pantograph link has an engagement slot. An engagement pin connected to an extension link is releasably received in the engagement slot during powered extension and retraction of the leg rest assembly. When an obstruction item in a return path of the leg rest assembly toward the retracted position is contacted, the engagement pin is released from the engagement slot allowing the leg rest assembly to return by gravity toward the retracted position after removal of the obstruction item from the return path. An elastically deflectable polymeric material rotation member is connected to the actuation mechanism permitting an occupant induced rocking motion of the actuation mechanism at least when the leg rest assembly is in the retracted position.

According to other embodiments, a furniture member having powered rocking motion includes a frame and an actuation mechanism movably connected to the frame permitting actuation mechanism forward and rearward rocking motions. A powered rocking drive device when energized is releasably engaged to both the actuation mechanism and the frame to automatically induce the forward and rearward rocking motions of the actuation mechanism.

According to other embodiments, a furniture member having powered rocking motion includes a frame and an actuation mechanism rotatably connected to the frame and movable in forward and rearward rocking motions with respect to the frame. A powered rocking drive device includes a motor connected to the actuation mechanism and a solenoid. The solenoid when energized releasably couples the motor to the frame such that operation of the motor automatically induces the forward and rearward rocking motions of the actuation mechanism. The solenoid when de-energized decouples the motor from the frame permitting an occupant to induce the forward and rearward rocking motions of the actuation mechanism with respect to the frame.

According to still other embodiments, a furniture member having powered rocking motion includes a frame and an actuation mechanism rotatably connected to the frame by a rocking motion biasing member. An electrically powered rocking drive device includes a motor and a drive shaft connected to the motor and releasably coupled to the actuation mechanism. The drive shaft is moved in reciprocating forward and rearward directions by operation of the motor. A solenoid is energized when the motor is energized and de-energized when the motor is de-energized. The solenoid when de-energized decouples the drive shaft from the actuation mechanism permitting an occupant to induce forward and rearward rocking motions of the actuation mechanism with respect to the frame. The solenoid when energized acts to releasably couple the drive shaft to the actuation mechanism such that operation of the motor automatically induces the forward and rearward rocking motions of the actuation mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
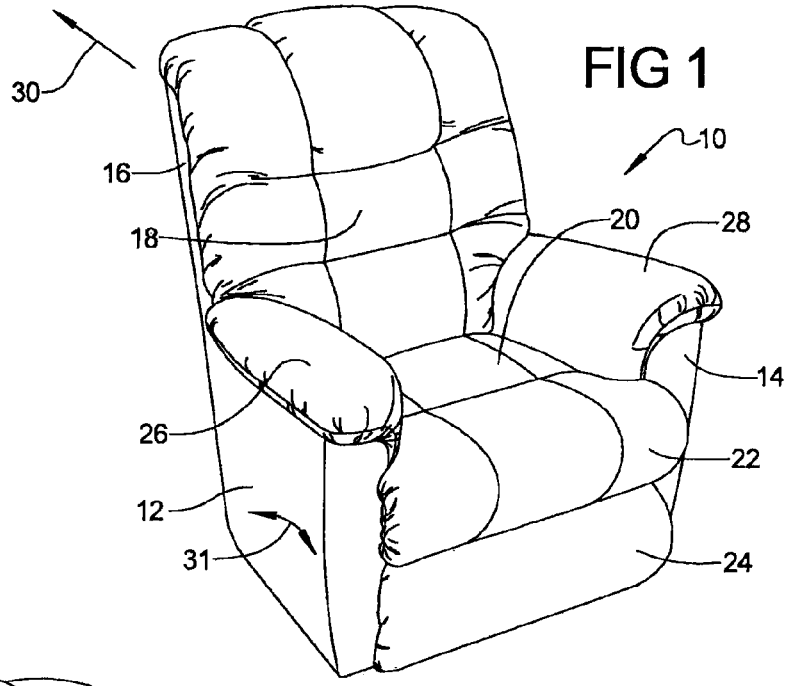
FIG. 1 is a front perspective view of a furniture member having an in-line linkage mechanism of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIG. 1, a furniture member 10 depicted as a reclining chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. An occupant's weight generally centered on support member 20 is normally operable to maintain seat back 16 in an upright position. When the leg rest assembly 24 is positioned in a stowed or retracted position shown, seat back 16 cannot be manually reclined or rotated with respect to a seat back arc of rotation 30. Seat back 16 rotates about arc of rotation 30 only after leg rest assembly 24 reaches a fully extended position shown and described with reference to FIGS. 12 and 13. Seat back 16 returns to the upright position shown and opposite to seat back arc of rotation 30 when a command is given by the occupant to return leg rest assembly 24 from a fully extended position to the fully retracted position shown.

According several embodiments, furniture member 10 can independently rotate or rock about a furniture member arc of rotation 31 by motion of the occupant and without requiring powered operation. In the embodiment shown, furniture member 10 is depicted as a chair however the present teachings are not limited to chairs. Furniture member 10 can be any of a plurality of furniture members, including, but not limited to single or multiple person furniture members, sofas, sectional members and/or loveseats.

Figure 2:
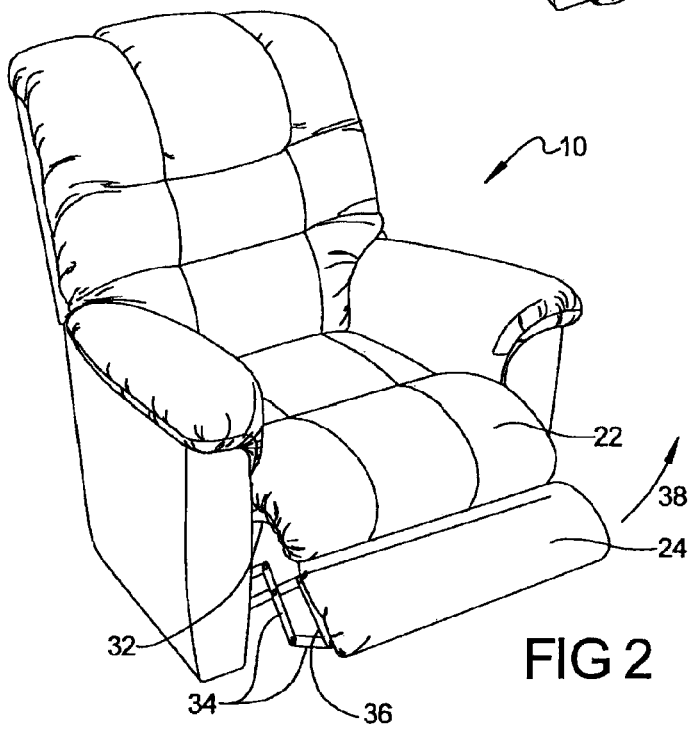
FIG. 2 is a front perspective view of the furniture member of FIG. 1 having a leg rest assembly shown in an extended position.

Referring generally to FIG. 2, an actuation mechanism 32 can be automatically actuated by command from the occupant to direct the repositioning of leg rest assembly 24 from the stowed position (shown in FIG. 1) to an extended position. Actuation mechanism 32 supports and permits both extension and retraction of leg rest assembly 24, as well as rotation of seat back 16. More specifically, actuation mechanism 32 includes first and second pantograph linkage sets 34, 35 (second pantograph linkage set 35 is not visible in this view) which are linked to leg rest assembly 24 using first and second leg rest support arms 36, 37 (only first leg rest support arm 36 is visible in this view). Leg rest assembly 24 can be moved from the fully retracted position (shown in FIG. 1) to an extended position by motion of the leg rest assembly 24 about an extension arc 38. It will be apparent that rotation of leg rest assembly 24 in an opposite direction from extension arc 38 will return the leg rest assembly 24 to the retracted position.

Figure 3:
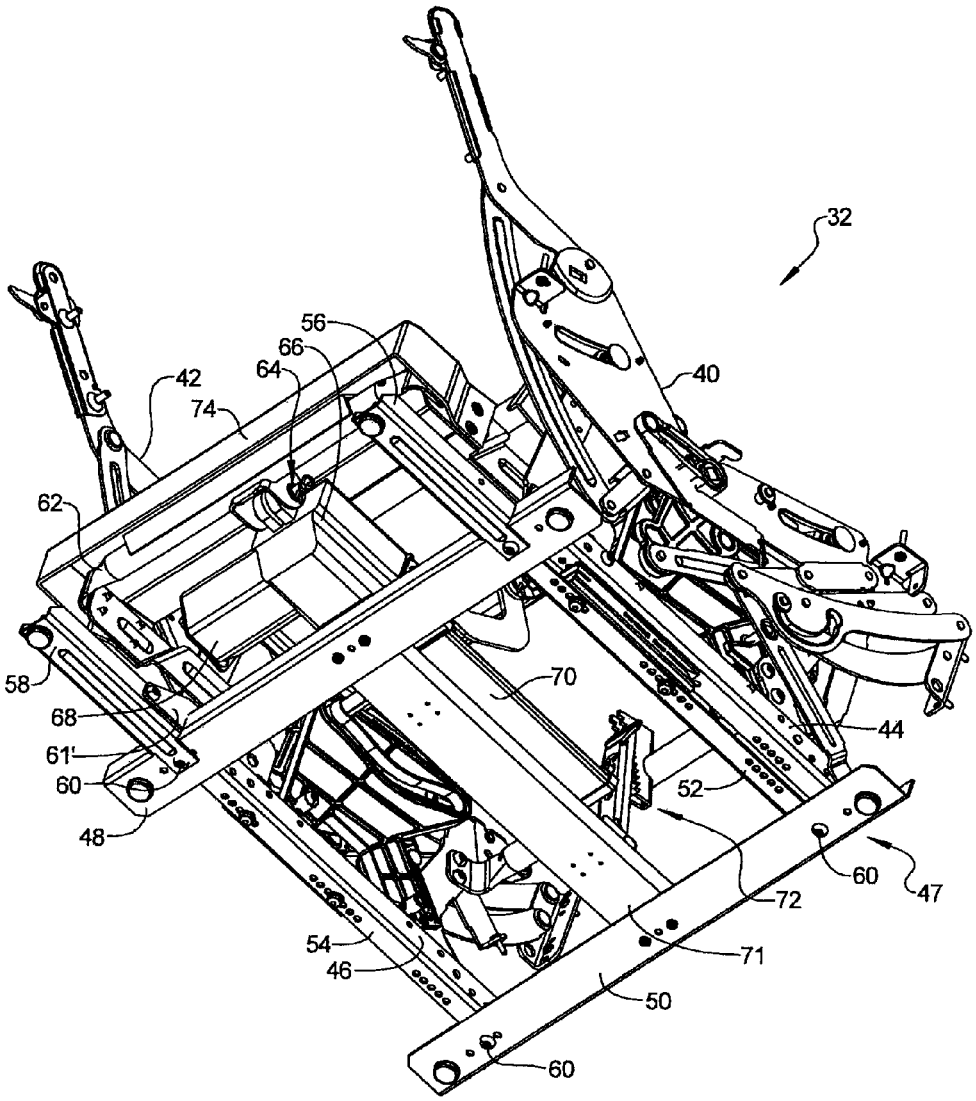
FIG. 3 is a bottom right perspective view of the mechanism of the present disclosure.

Referring to FIG. 3, the functional and structural aspects of actuation mechanism 32 for use in either single or multi-person furniture members 10 is shown. For purposes of clarity, FIG. 3 shows the various pre-assembled frame components with their upholstery, padding, etc. removed to better illustrate the interdependency of the mechanism components' construction which can be rapidly and efficiently assembled. Therefore, all of the mechanism components can be individually fabricated or sub-assembled to include the requisite brackets, springs, padding and upholstery on an "off-line" batch-type basis. Thereafter, the various pre-assembled and upholstered furniture components are assembled for totally integrating actuation mechanism 32 therein.

Actuation mechanism 32 provides multiple features which will each be separately described, including: 1) a linkage portion; 2) a motor and gear system to permit powered operation of furniture member 10; 3) a ratchet and pawl feature which retains the leg rest assembly 24 in multiple extended positions without the biasing force of spring elements; and 4) an operation control system that permits independent automatic operation of leg rest assembly 24 and seat back 16.

As generally used herein, the terms front or forward and right hand or left hand are oriented with respect to the direction an occupant of the furniture member 10 faces when seated or with respect to the occupant's sides when the occupant is seated. The terms rear or rearward refer to a direction opposite to the front or forward direction. The linkage portion of actuation mechanism 32 includes right and left side assemblies 40, 42, which are connected to and supported on right and left side support members 44, 46. Right and left side support members 44, 46 are themselves rotatably connected to a frame support structure 47 such that right and left side support members 44, 46 and right and left side assemblies 40, 42 can collectively and/or independently move with respect to frame support structure 47.

Frame support structure 47 includes multiple frame members including rear and front cross frame members 48, 50, right and left lateral frame members 52, 54, and right and left frame extensions 56, 58. Occupant loads at a front portion of furniture member 10 are transferred from right and left lateral frame members 52, 54 to front cross frame member 50 which is connected such as by threaded fasteners or rivets 60 to right and left lateral frame members 52, 54. Similarly, occupant loads at a rear portion of the furniture member 10 are transferred from right and left lateral frame members 52, 54 to rear cross frame member 48 which is connected such as by threaded fasteners or rivets 60 to right and left lateral frame members 52, 54. Right and left frame extensions 56, 58 are connected to rear cross frame member 48 by threaded fasteners or rivets 60 and by brackets 61, 61' (only left side bracket 61' is visible in this view). In some embodiments the frame members can each be created from formed, bent and/or extruded angle elements, of metal such as steel or aluminum, or of polymeric or composite materials. The present disclosure is not limited by the material used for the frame components.

A rear cross support member 62 connects right and left side support members 44, 46. A hinge pin assembly 64 connected to cross support member 62 rotatably supports an electrically powered and occupant controlled drive assembly 66. A motor 68 such as an AC or DC electric motor is connected to drive assembly 66 to provide powered operation of actuation mechanism 32 via drive assembly 66. A gear housing 70 can extend forward from drive assembly 66 and provide for a gear drive such as a worm drive gear. Drive assembly 66 and gear housing 70 are together freely rotatable above a central lateral frame member 71. Central lateral frame member 71 supports a portion of a ratchet and pawl assembly 72 which is also freely disposed with respect to gear housing 70. A cover member 74 is connected to right and left lateral frame members 52, 54 which at least partially cover hinge pin assembly 64, drive assembly 66 and motor 68.

Figure 4:
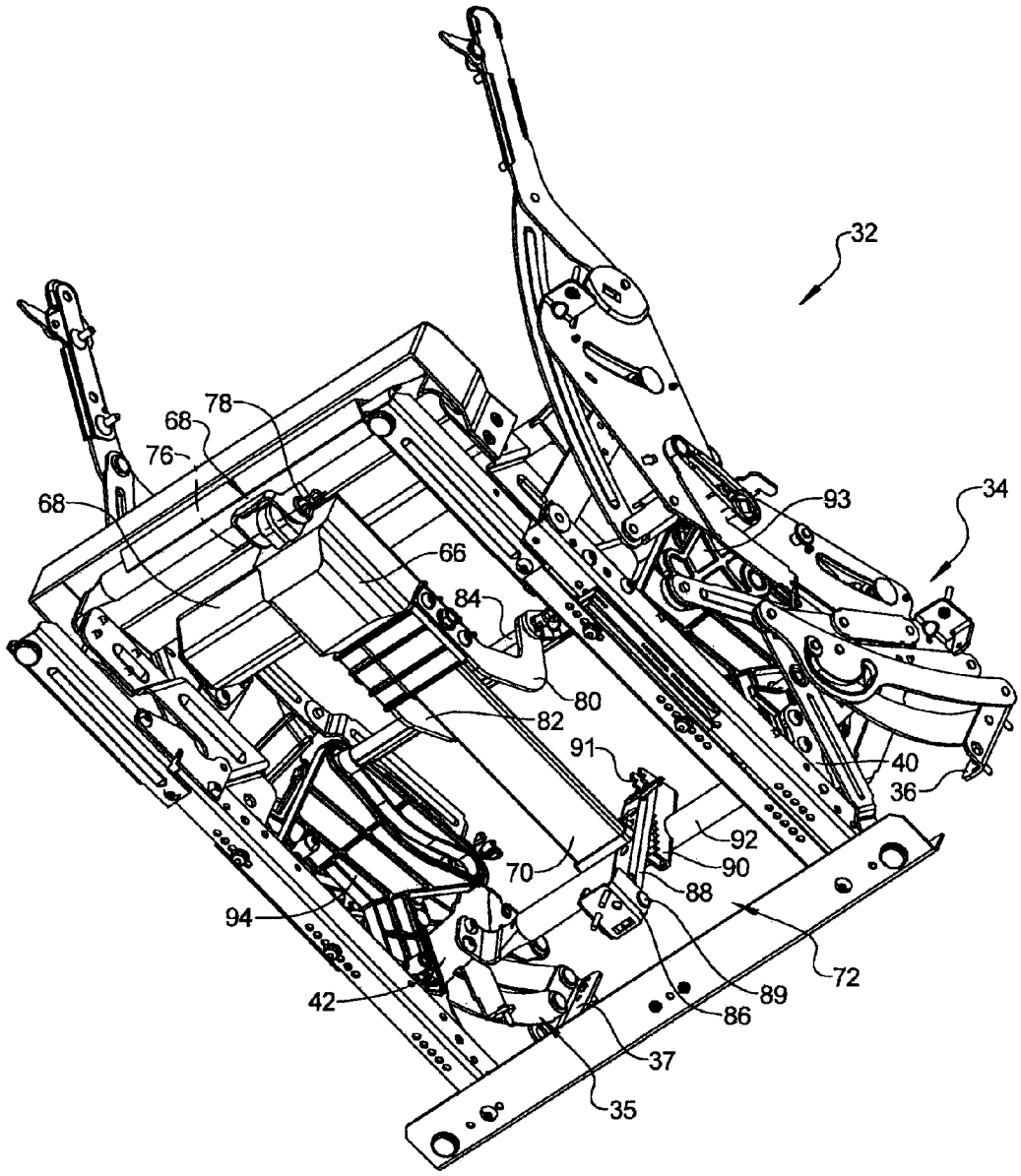
FIG. 4 is a bottom right perspective view similar to FIG. 3 further showing selected frame members removed for clarity.

Referring to FIG. 4, drive assembly 66 is rotatable about a longitudinal axis of rotation 76 defined by a hinge pin 78 rotatably received in hinge pin assembly 64. Drive assembly 66 including motor 68 and gear housing 70 rotate about longitudinal axis of rotation 76 from the position shown in FIG. 4 to an upward position or position rotated away from the viewer as viewed in FIG. 4 as the leg rest assembly 24 (only partially shown in this view as first and second leg rest support arms 36, 37) is rotated from the stowed position to an extended position. The drive assembly 66 is connected using first and second rigid drive links 80, 82 to a drive rod 84. Each of the first and second rigid drive links 80, 82 are fixedly connected to drive assembly 66.

Rocking motion of actuation mechanism 32 described with reference to FIG. 1 is precluded for any extended position of leg rest assembly 24 by engagement of ratchet and pawl assembly 72. Ratchet and pawl assembly 72 includes a pawl support bracket 86 which rotatably supports a pawl member 88 via a pivot pin 89. A ratchet 90 is fixedly connected to a front cross support member 92 fixedly connected between opposite sides of actuation mechanism 32. As leg rest assembly 24 extends, pawl member 88 engages individual teeth 91 of ratchet 90 which both prevents further rocking motion of the actuation mechanism 32 and temporarily creates a hold position of leg rest assembly 24 until a control command is given by the occupant of the furniture member to return leg rest assembly 24 from any extended position to the retracted position.

Actuation mechanism 32 further includes opposed first and second sequencing plates 93, 94, which according to several embodiments can be created such as a molding of a polymeric material such as polyoxymethylene. The material selected for first and second sequencing plates 93, 94 provides structural rigidity while also providing for reduced friction during sliding/rotating motion of drive rod 84. Material for the first and second sequencing plates 93, 94 can also be other polymeric materials or can be cast or formed from a metal material such as aluminum. First and second sequencing plates 93, 94 receive opposed ends of drive rod 84 to provide a rotational and displacement passage for drive rod 84.

Figure 5:
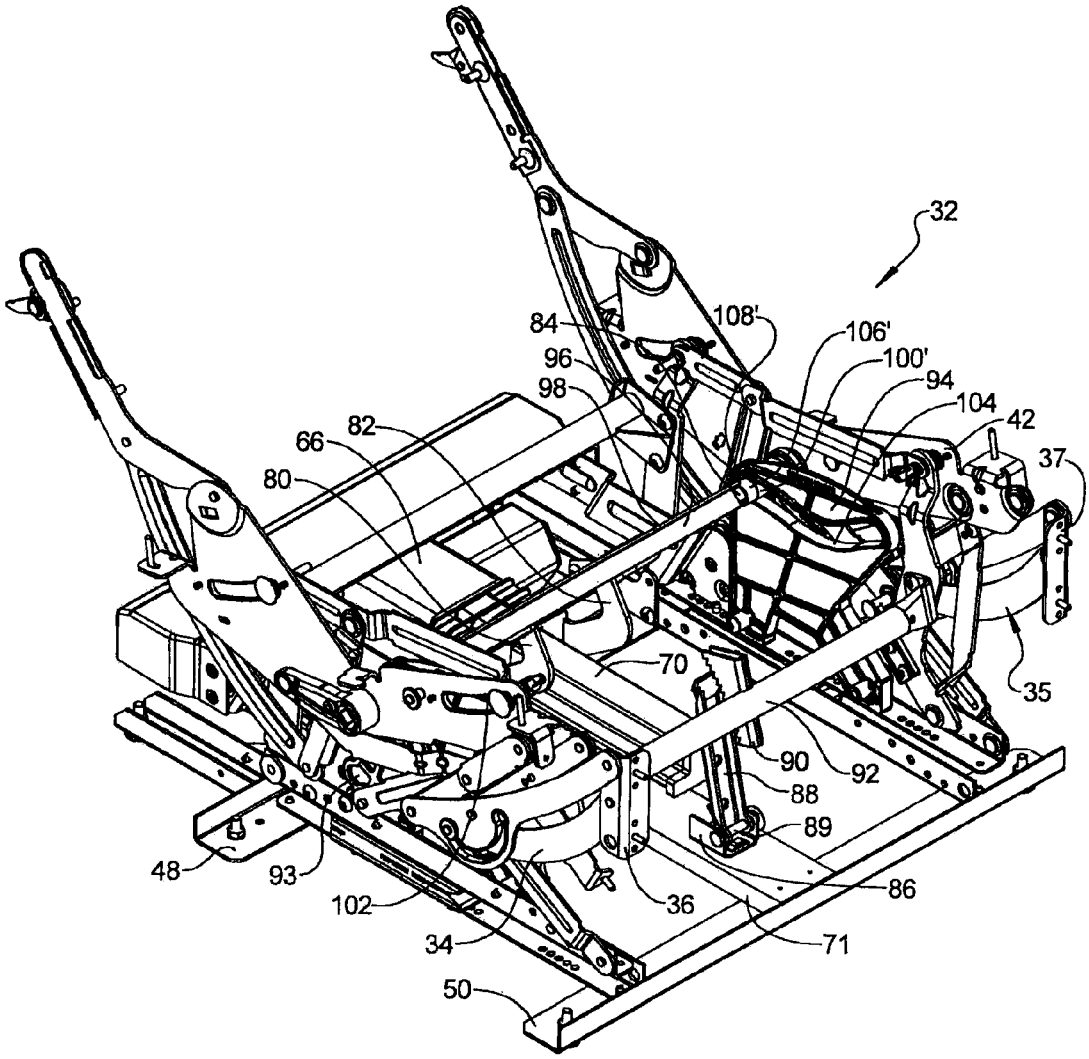
FIG. 5 is a front right perspective view of the mechanism of FIG. 3.

Referring to FIG. 5, both a rotational and a translational load is imparted to drive rod 84 by the first and second rigid drive links 80, 82, therefore drive rod 84 may be longitudinally stiffened using a reinforcing member 96 fixed, for example, by welding to drive rod 84. Reinforcing member 96 can be in the form of an L-shaped bracket having a reinforcing member leg 98. A polymeric bushing 100, 100' is attached at both opposed ends of drive rod 84. The polymeric bushings 100, 100' are individually slidably received in one of a first or second curved elongated channel 102, 104 each created in one of the first and second sequencing plates 93, 94. To align and retain the polymeric bushings 100, 100' within the first and second curved elongated channels 102, 104, a spacer member 106, 106' (spacer member 106 is not visible in this view) is positioned between each polymeric bushing 100, 100' and the reinforcing member 96. In the leg rest fully retracted position shown, each of the polymeric bushings 100, 100' and the drive rod 84 are positioned proximate to or in contact with a first channel end wall 108, 108' (first channel end wall 108 is not visible in this view) of the first and second curved elongated channels 102, 104. As clearly seen in FIG. 5, central lateral frame number 71 provides a connection location and direct support of pawl support bracket 86 and pawl member 88.

Figure 6:
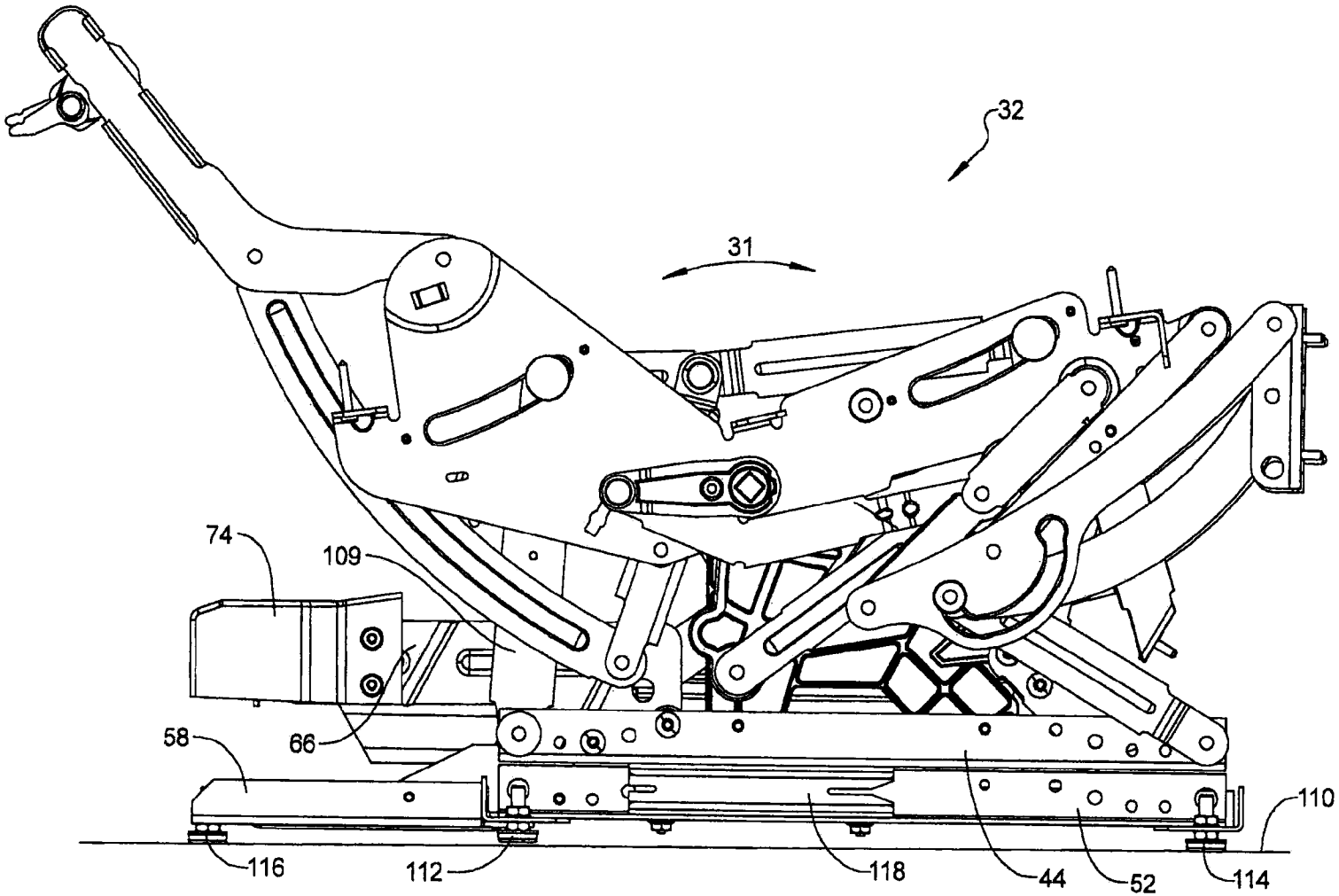
FIG. 6 is right side elevational view of the mechanism of FIG. 3.

Referring to FIG. 6, actuation mechanism 32 can be supported directly on a planar floor surface 110 using a combination of a rear adjustable height leg 112, a front adjustable height leg 114, and a frame extension adjustable height leg 116, which are each duplicated on opposite sides of the actuation mechanism 32. In order to provide for rocking motion of the actuation mechanism 32, a rocking motion biasing member 118 is connected such as by fastening between the side support members such as right side support member 44 shown and the lateral frame members such as right lateral frame member 52. Rocking motion biasing member 118 therefore provides for furniture member arc of rotation 31. As evident in FIG. 6, cover 74 extends at least partially over the rearward extension of drive assembly 66 with respect to a rear support link 109. According to several embodiments, rocking motion biasing member 118 acts as a rotation and/or biasing member for the furniture member and can be made of an elastically flexible, resilient polymeric material. According to several embodiments, rocking motion biasing member 118 is completely defined as a block shape such as a rectangle, having no coils or extending members common to coiled spring biasing members.

Figure 7:
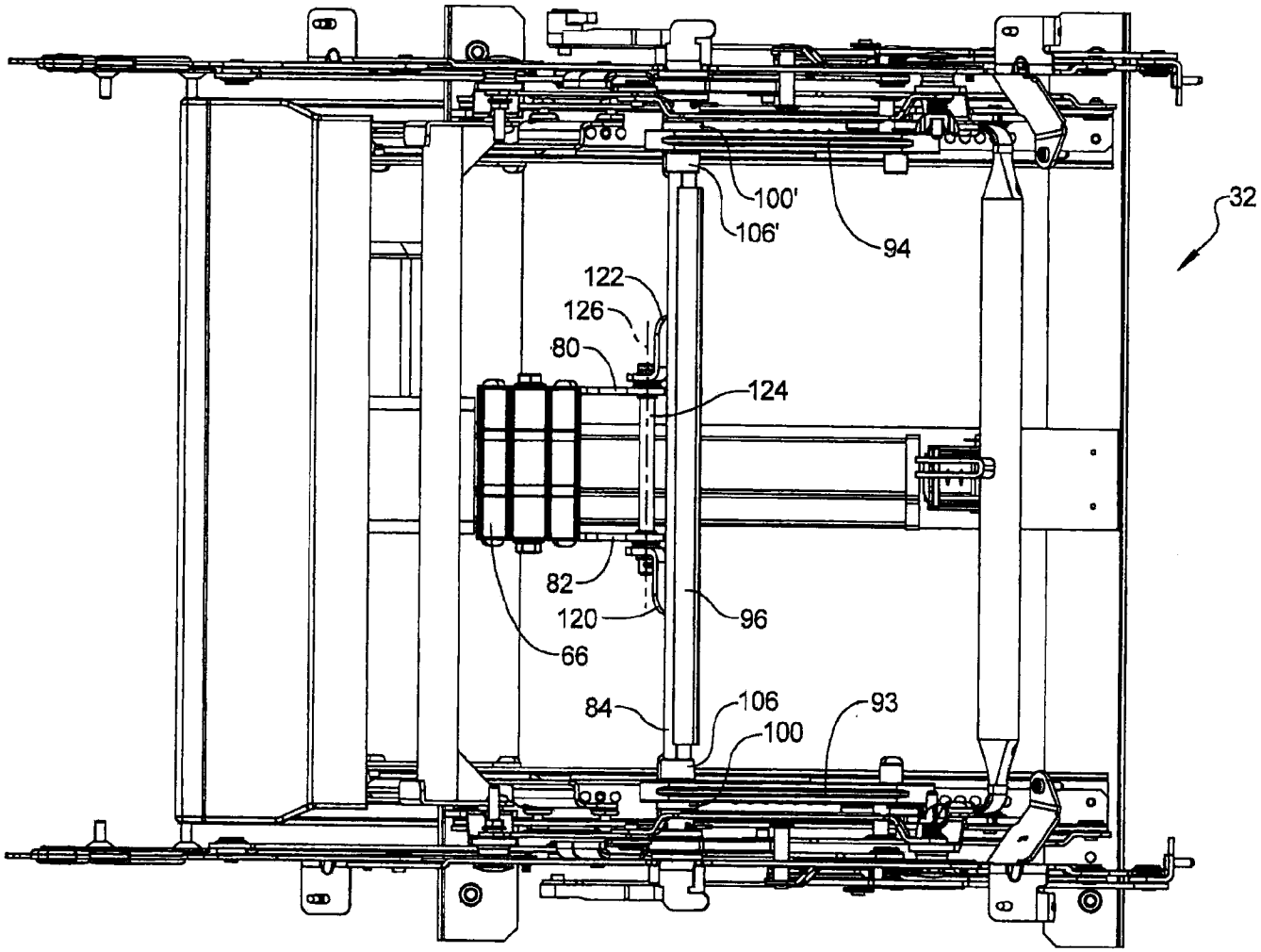
FIG. 7 is a top plan view of the mechanism of FIG. 3.

Referring to FIG. 7, as previously noted, first and second rigid drive links 80, 82 are fixedly connected to drive assembly 66. To provide for axial rotation of drive rod 84, the first and second rigid drive links 80, 82 are therefore rotationally connected to the drive rod 84 using first and second drive rod connecting links 120, 122, which are each rotatably connected to a bracket support pin 124 such that first and second drive rod connecting links 120, 122 rotate with respect to a support pin axis of rotation 126 of bracket support pin 124. Drive rod 84 can therefore axially rotate as well as translate forward and rearward in order to achieve the various extended positions and the retracted position of the leg rest assembly as well as the seat back. First and second drive rod connecting links 120, 122 are fixedly connected such as by welding or fastening to drive rod 84, therefore axial rotation of drive rod 84 is induced by the generally upward and downward rotational movement of first and second rigid drive links 80, 82 causing rotation of first and second drive rod connecting links 120, 122 with respect to bracket support pin 124.

Figure 8:
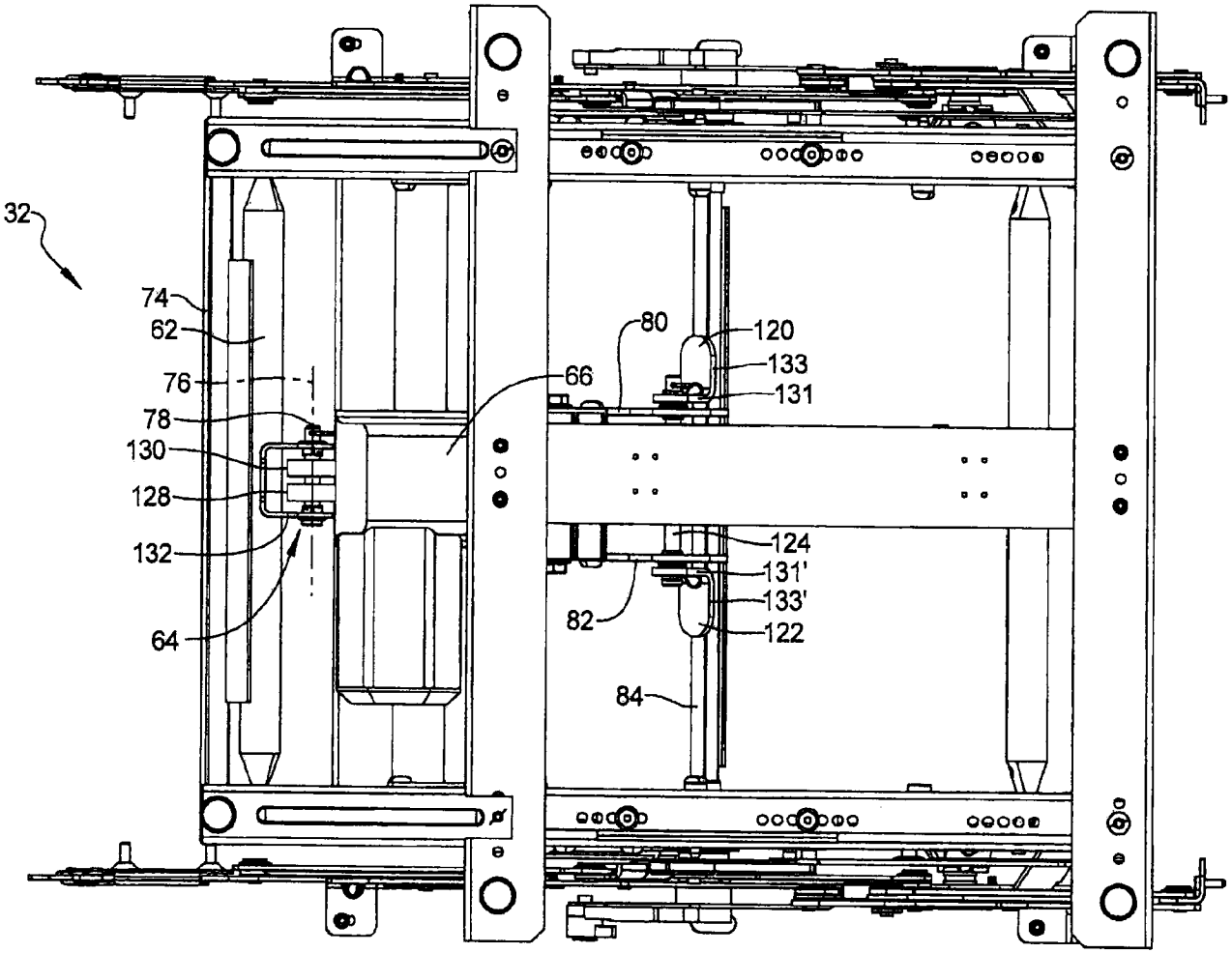
FIG. 8 is a bottom plan view of the mechanism of FIG. 3.

Referring to FIG. 8, the hinge pin assembly 64 provides for rotational connection between drive assembly 66 and rear cross support member 62. First and second support arms 128, 130 extend rearwardly from drive assembly 66, having hinge pin 78 rotatably disposed therethrough. Outward ends of hinge pin 78 are also captured by opposed bracket legs of a U-shaped bracket 132 permitting rotation about longitudinal axis of rotation 76. As more clearly evident in this view, the first and second drive rod connecting links 120, 122 can be formed as L-shaped members each having a first leg 131, 131' and a second leg 133, 133'. Bracket support pin 124 is rotatably received through the first legs 131, 131'.

Figure 9:
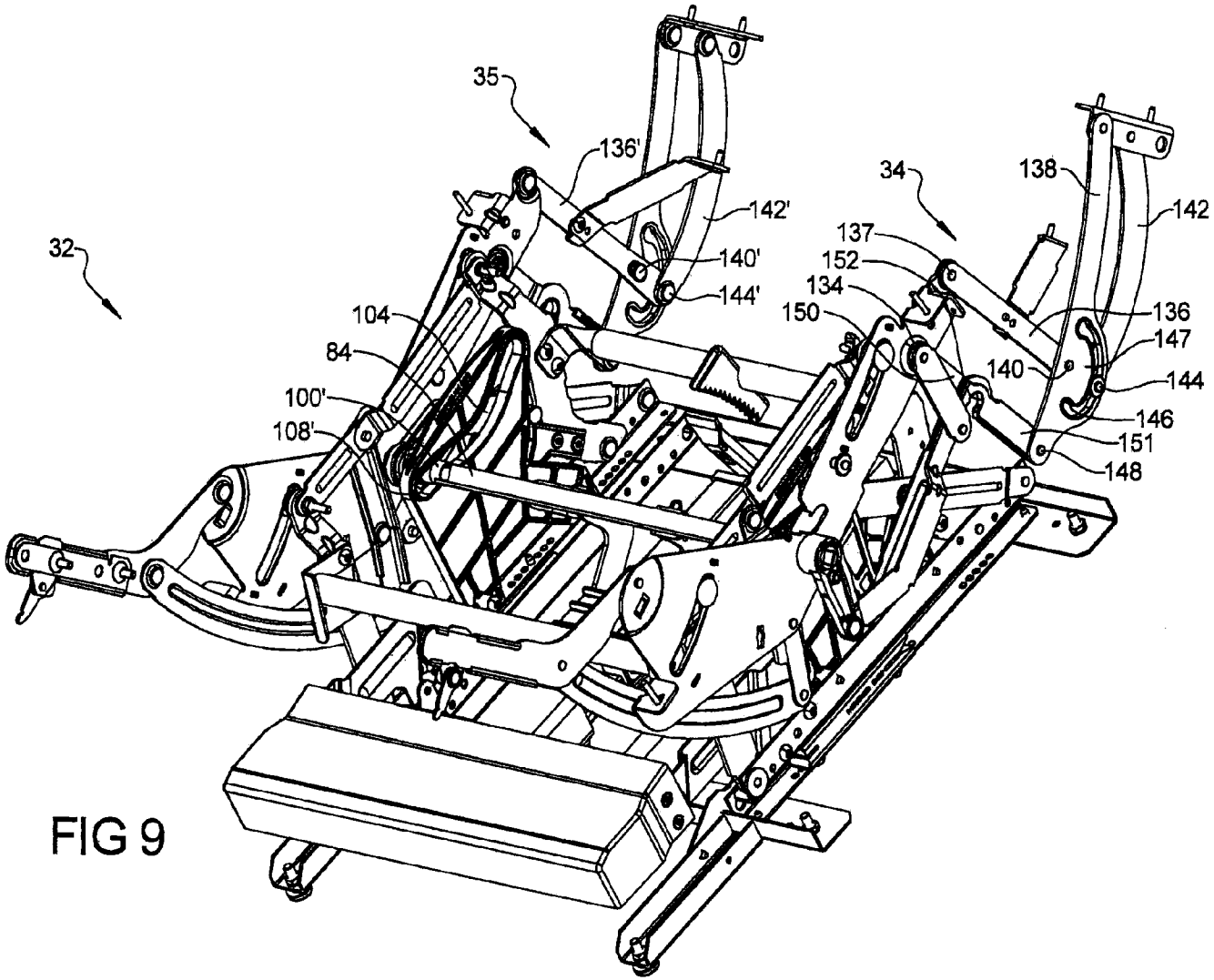
FIG. 9 is a rear right perspective view of the mechanism in a partially extended leg rest release position.

Referring to FIG. 9, each of the first and second pantograph linkage sets 34, 35 are shown in a release position which can occur as the first and second pantograph linkage sets 34, 35 are returning from an extended position toward the retracted position if contact is made by one or both of the first and second pantograph linkage sets 34, 34 or the leg rest assembly 24 (not shown in this view) with an object under the pantograph linkage sets or leg rest assembly 24. In the example shown in FIG. 9, drive rod 84 is moving rearwardly within first and second elongated channels 102, 104 and has nearly reached the first channel end wall 108, 108' which would normally establish the fully retracted position of the leg rest assembly.

Each of the first and second pantograph linkage sets 34, 35 are similarly constructed, therefore the following description of first pantograph linkage set 34 is equally applicable to second pantograph linkage set 35. A mechanism side plate 134 has a first pantograph link 136 rotatably connected to the mechanism side plate 134 using a pin 137. A leg rest support link 138 is rotatably connected to first pantograph link 136 using a pin 140. A leg rest angle control link 142 is also rotatably connected to first pantograph link 136 using a multiple connection pin 144. Multiple connection pin 144 is slidably disposed within an elongated U-shaped slot 146 created in an extended width portion 147 of leg rest support link 138. A pin 148 rotatably connects an end of leg rest support link 138 to a second pantograph link 150. A polymeric attachment 151 is attached to second pantograph link 150 which will be shown and described in greater detail in reference to FIGS. 14 and 15. An engagement slot 152 is provided in polymeric attachment 151 to permit release of the first pantograph linkage set 34 upon contact with an object during retraction of the pantograph linkage set 34.

Figure 10:
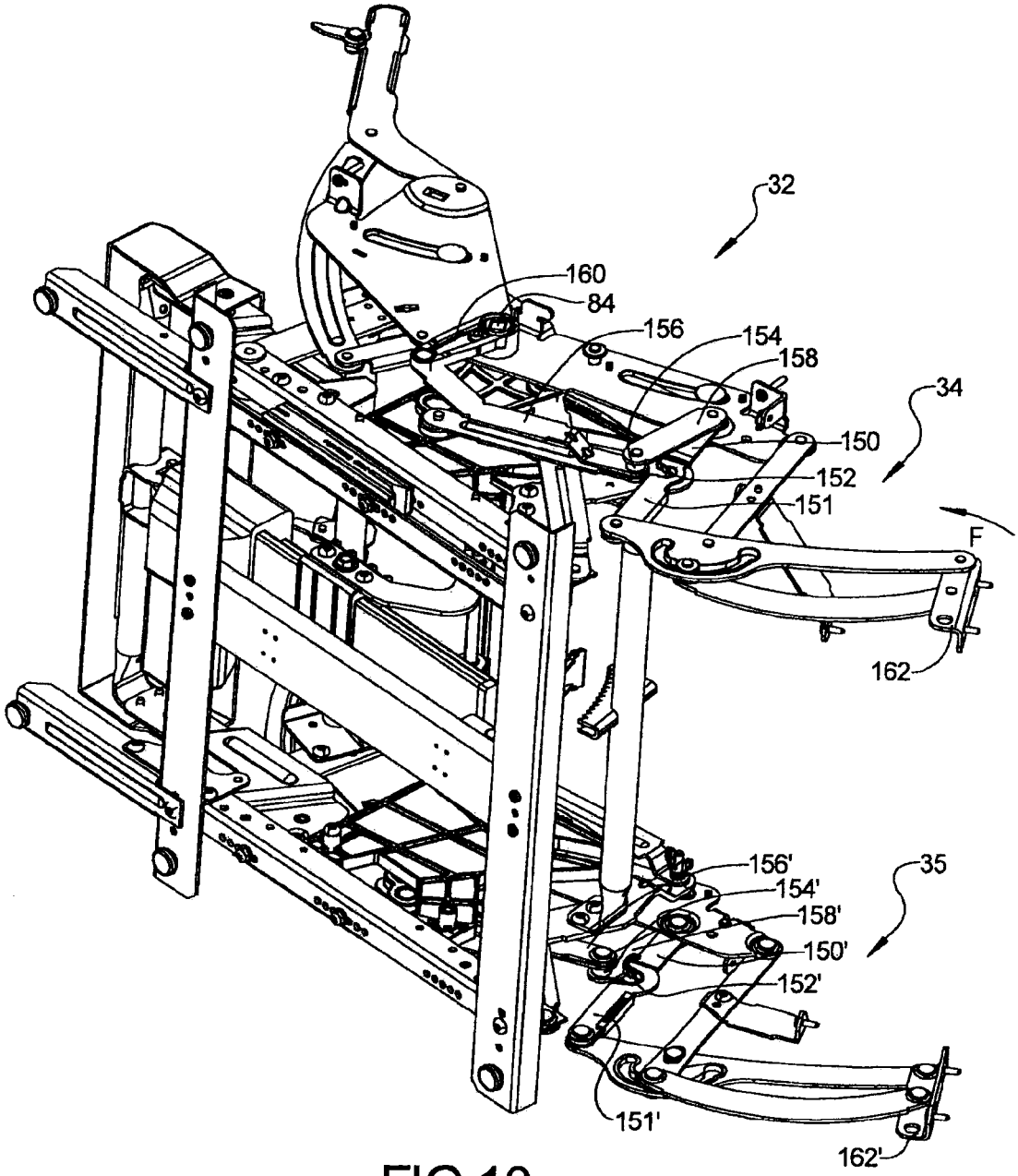
FIG. 10 is a bottom right perspective view of the mechanism of FIG. 9.

Referring to FIG. 10, engagement slot 152 normally receives and releasably captures an engagement pin 154, which is connected at a free end of an extension link 156. Engagement pin 154 is also rotatably connected at a free end of a carrier link 158. Engagement pin 154, when seated within engagement slot 152, permits normal extension and retraction of each of the first and second pantograph linkage sets 34, 35. When the engagement pin 154 releases out of (or freely away from) the engagement slot 152, the pantograph linkage set is thereafter freely rotatable with respect to extension link 156, which continues to be rotatably retracted to the leg rest retracted position by rotatable connection to a leg rest lock link 160. Leg rest lock link 160 is fixed to a free end of drive rod 84 such that rotation of drive rod 84 co-rotates the leg rest lock link 160. An orientation of engagement slot 152 is provided having an opening into the engagement slot facing rearward allowing extension link 156 to continue in powered motion in a rearward direction if engagement pin 154 is released from the engagement slot 152. When engagement pin 154 is disengaged from engagement slot 152, the pantograph linkage set 34 can either remain at its position due to an obstruction item 159 it has contacted or is thereafter free to gravity rotate toward the leg rest retracted position when the obstruction item is removed from under the pantograph linkage set. A force "F" applied to the leg rest assembly 24 through leg rest connection brackets 162, 162' (for example by the occupant) is thereafter required to reset engagement pin 154 into engagement with engagement slot 152, which will be described in further detail in reference to FIGS. 14 and 15. Carrier link 158 maintains a repeatable position of engagement pin 154 to permit re-engagement of engagement pin 154 within engagement slot 152.

Figure 11:
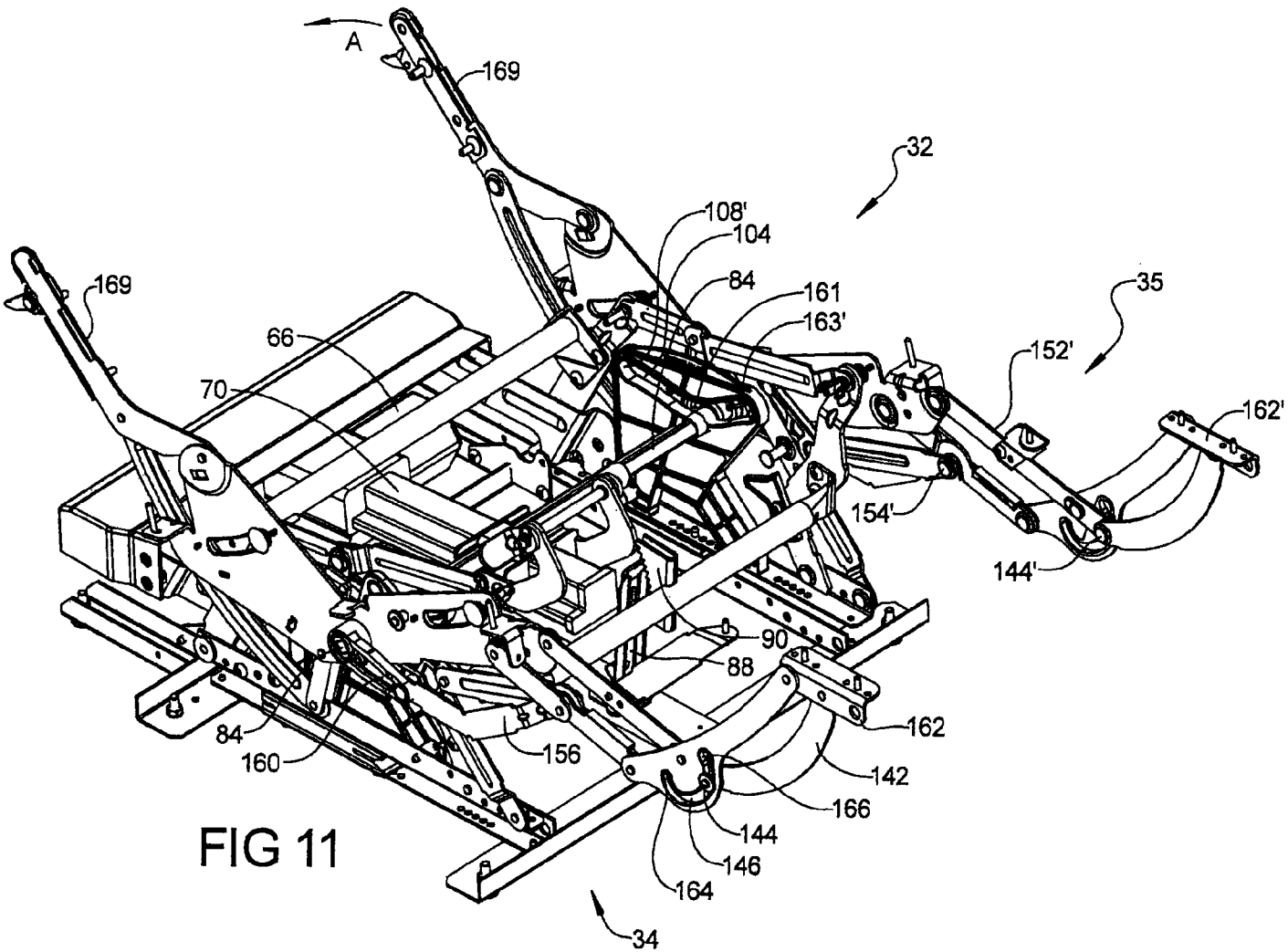
FIG. 11 is a top right perspective view of the mechanism in a leg rest fully extended position.

Referring to FIG. 11, a fully extended position of leg rest assembly 24 and first and second pantograph linkage sets 34, 35 is provided when drive rod 84 reaches a lowest elevation slot position 161 of first and second curved elongated channels 102, 104 (first curved elongated channel 102 is not clearly visible in this view). In the fully extended position, the multiple connection pin 144 is positioned furthest away from a first slot end wall 164 of the U-shaped slot 146 and closest to a second slot end wall 166 of the U-shaped slot 146. This positioning of multiple connection pin 144 extends leg rest angle control link 142 to a furthest forward position which fully rotates the first and second leg rest support arms 36, 37 and first and second leg rest connection brackets 162, 162'. The fully extended position of leg rest assembly 24 is reached when drive rod 84 fully rotates leg rest lock link 160 in a forward directed rotation which fully extends extension link 156 in a forward direction. Also in the fully extended position, engagement pin 154 is fully engaged within engagement slot 152 and maintained fully engaged by gravity plus the weight of the occupant's legs on leg rest assembly 24.

During extension of the leg rest assembly 24 from the retracted to the fully extended position, right and left seat back support members 168, 169 are maintained in a seat back upright orientation. Once the fully extended position of leg rest assembly 24 is reached, further rotation of drive assembly 66 and gear housing 70 no longer functions to axially rotate the drive rod 84, but instead forwardly translates drive rod 84 within first and second curved elongated channels 102, 104 from the lowest elevation slot position 161 until drive rod 84 is positioned proximate to or contacts a second channel end wall 163, 163' (second channel end wall 163 is not clearly visible in this view). Translation motion of drive rod 84 from the lowest elevation slot position 161 until positioned proximate to or in contact with second channel end wall 163, 163' generates a continuous rearward rotation of right and left seat back support members 168, 169 in a seat back arc of rotation "A".

To return from the fully extended position of leg rest assembly 24 to the fully retracted position, actuation mechanism 32 is operated in an opposite manner. Initially, with drive rod 84 in contact with second channel end wall 163, 163' downward rotation of drive assembly 66 and gear housing 70 results in translation in a rearward direction of drive rod 84 until drive rod 84 once again reaches the lowest elevation slot position 161. From this position, combined axial rotation and rearward translation of drive rod 84 again occurs from further downward rotation of drive assembly 66 and gear housing 70 which rotates leg rest lock links 160, 160' pulling extension links 156, 156' rearward and returning the pantograph linkage sets 34, 35 toward the retracted position. It is further noted that downward rotation of gear housing 70 after the leg rest fully extended position is reached causes disengagement of the pawl member 88 from ratchet 90 which permits rotation of the pantograph linkage sets 34, 35. It is also noted that first and second curved elongated channels 102, 104 define a generally V-shape configuration having the lowest elevation slot position 161 downwardly positioned with respect to each of the first channel end wall 108 and second channel end wall 163 positions.

Figure 12:
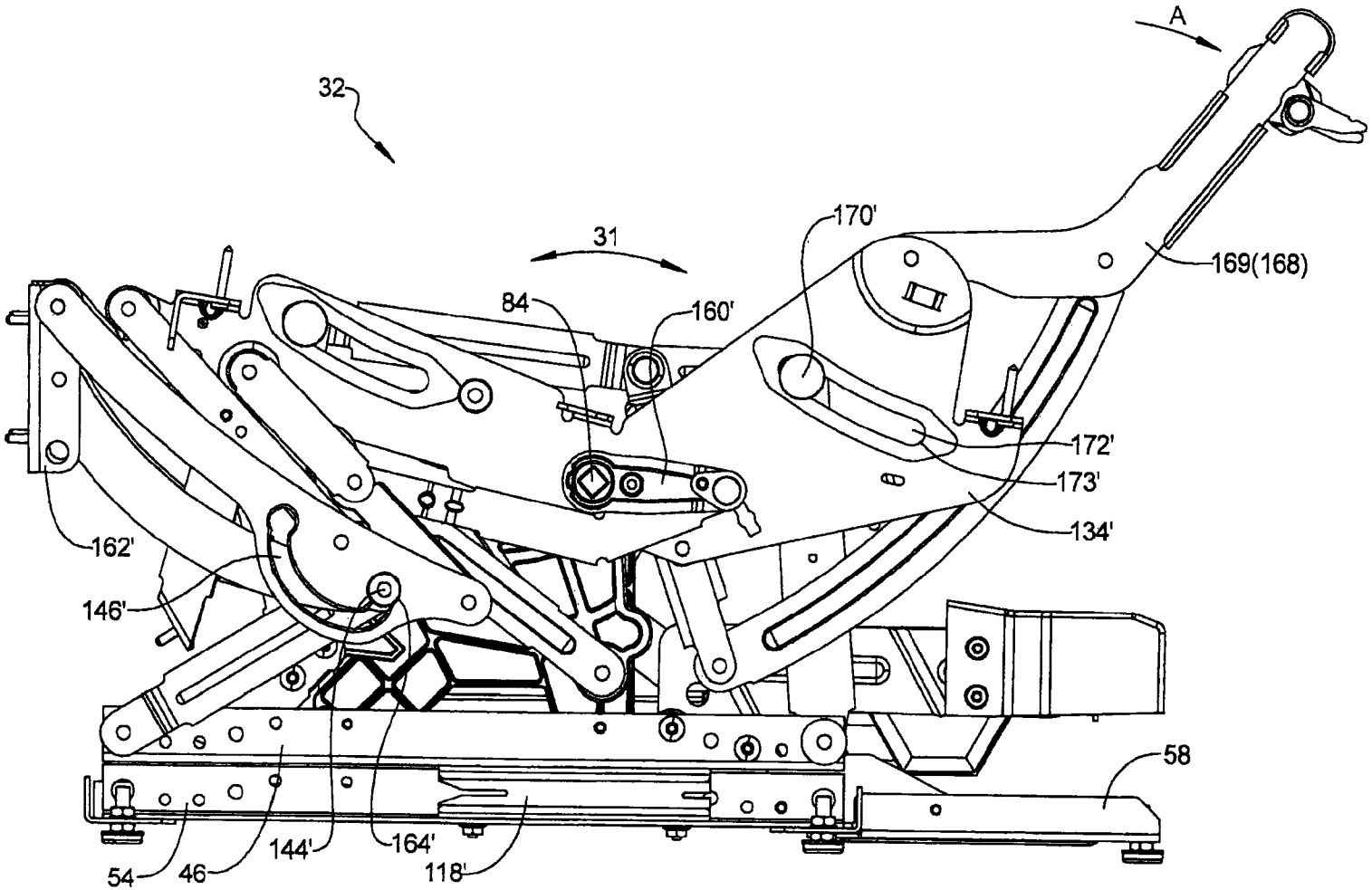
FIG. 12 is a left side elevational view of the mechanism in a leg rest fully retracted position.

Referring to FIG. 12, the fully retracted position of leg rest assembly 24 shown permits rocking motion of actuation mechanism 32 about furniture member arc of rotation 31. Right and left seat back support members 168, 169 (only left seat back support member 169 is visible in this view) are positioned in the seat back upright position and can move in the seat back arc of rotation "A" during powered actuation by sliding movement of a seat back motion pin 170, 170' within an elongated slot 172, 172' (seat back motion pin 170 and elongated slot 172 are not clearly visible in this view). Contact between the seat back motion pin 170' with a slot end wall 173 defines the fully rotated seat back position. As previously noted, positioning rocking motion biasing member 118' between left side support member 46 and left lateral frame member 54 permits rocking motion with respect to furniture member arc of rotation 31 of the components of actuation mechanism 32 which are positioned above left side support member 46. Occupant induced (non-powered) rocking motion of actuation mechanism 32 is permitted at least when leg rest assembly 24 is positioned in the fully retracted position and the right and left seat back support members 168, 169 are positioned in the seat back fully upright position shown, or after disengagement of pawl member 88 from ratchet 90 (shown and described with reference to FIG. 11) but before leg rest assembly 24 has completely returned to its fully retracted position. Frame extensions, such as left frame extension 58, provide additional support of actuation mechanism 32 for rearward rotation during rocking motion.

Figure 13:
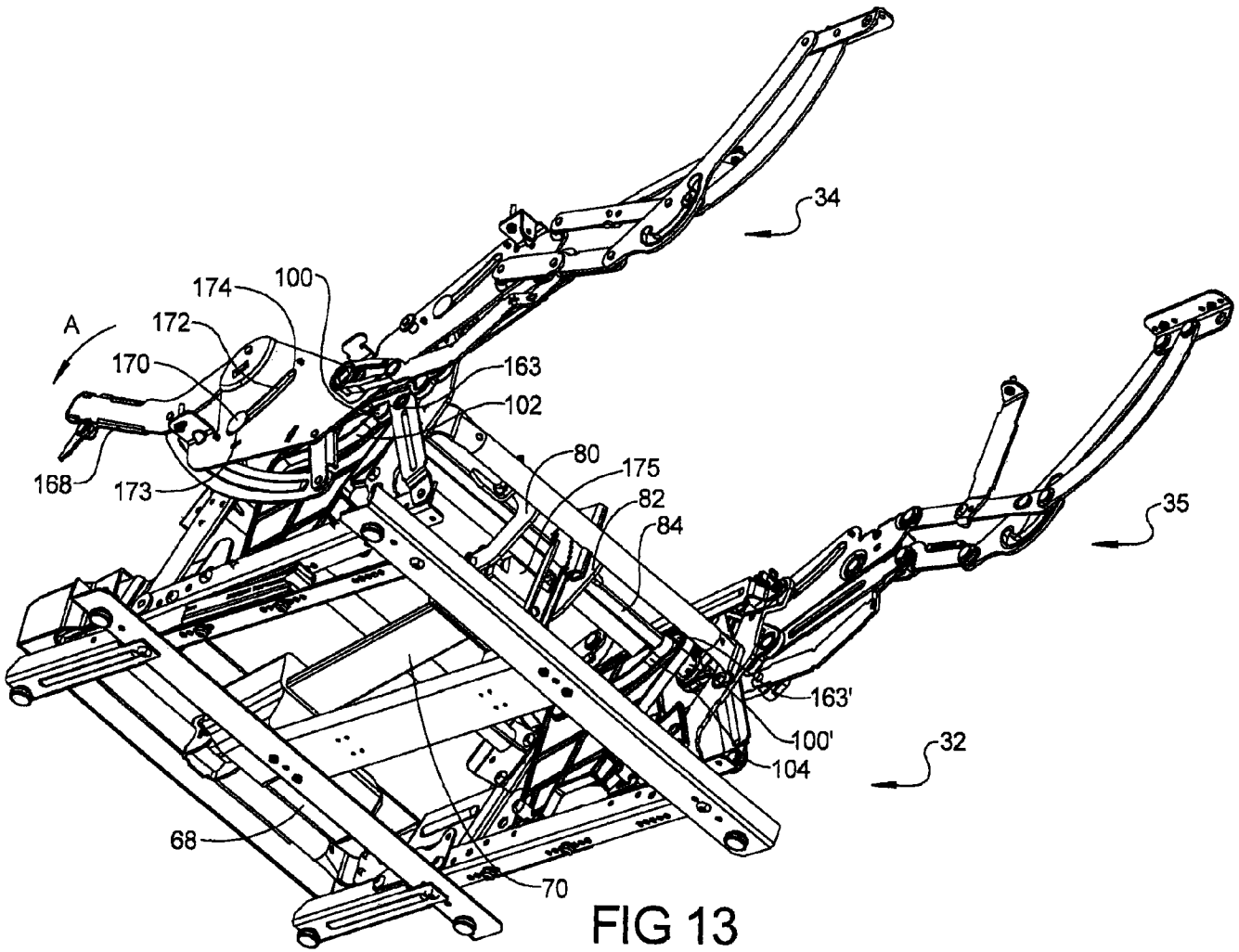
FIG. 13 is a bottom right perspective view of the mechanism in a leg rest fully extended and seat back fully reclined positions.

Referring to FIG. 13, actuation mechanism 32 is shown with leg rest assembly 24 in the fully extended position and right and left seat back support members 168, 169 rotated to the seat back fully rotated position achieved by rotation through seat back arc of rotation "A". Seat back motion pin 170 has translated away from contact with a second slot end wall 174 of elongated slot 172 and contacts slot end wall 173 in the seat back fully rotated position. Also in the seat back fully rotated position, the polymeric bushings 100, 100' contact the second channel end walls 163, 163' of each of the first and second curved elongated channels 102, 104. As most clearly seen in this view, both first and second rigid drive links 80, 82 are fixedly (such as by fastening) connected to a carriage assembly 175 which is longitudinally translated along and guided by gear housing 70 during operation of motor 68. Carriage assembly 175 reaches its fullest forward extension along gear housing 70 when the right and left seat back support members 168, 169 reach the seat back fully rotated position.

Referring again to FIGS. 1, 2, 6, 9 and 10, rocking furniture member 10 of the present disclosure therefore includes an actuation mechanism 32 including an extendable and retractable leg rest assembly 24. An electrically powered and occupant controlled drive assembly 66 connected to the actuation mechanism 32 operates upon receipt of a command from an occupant of the furniture member 10 to move the leg rest assembly 24 between a retracted position (shown in FIGS. 1 and 3 and any of a plurality of extended positions shown in FIGS. 2 and 9 inclusive including a fully extended position (shown in FIG. 11. An elastically deflectable polymeric material rotation member 118 is connected to the actuation mechanism 32 permitting an occupant induced rocking motion (about arc of rotation 31) of the actuation mechanism 32 at least when the leg rest assembly 24 is in the retracted position.

Referring to FIG. 14 and again to FIG. 5, an actuation mechanism 200 includes a leg rest assembly 202 having first and second pantograph linkage sets 204, 206 which are extendible or retractable to the stowed position shown. Actuation mechanism 200 is modified from actuation mechanism 32 with the inclusion of an electrically, pneumatically, or otherwise powered rocking drive device 208 which allows for powered automatic rocking motion of the actuation mechanism 200. Automatic rocking motion is defined herein as a powered rocking motion which does not rely on force or input by an occupant of the furniture member. Actuation mechanism 200 is supported and connected to frame support structure 47' and includes rear and front cross members 48', 50' which are fastenably connected to first and second longitudinal frame members 52', 54'. Actuation mechanism 200 is therefore capable of the full rocking motion, as previously described herein, with respect to frame support structure 47'. Drive assembly 66' and motor 68' are further included, as previously described, to provide for powered actuation of the leg rest assembly 202 as well as powered movement of the right and left side assemblies 40', 42' for movement of the seat back from the upright to the fully reclined positions.

Figure 14:
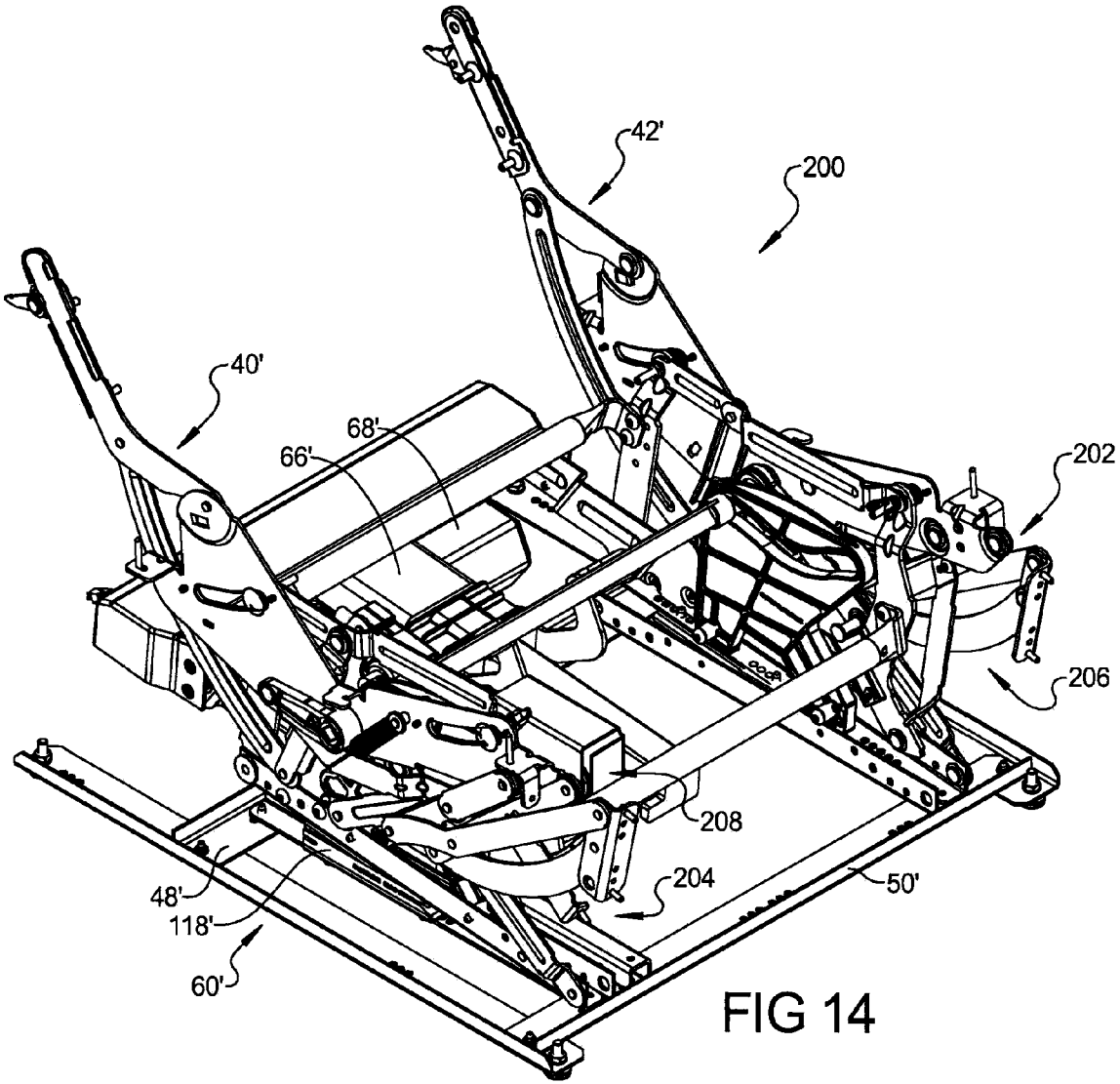
FIG. 14 is a front right perspective view of a furniture mechanism of another embodiment having a powered rocking motion.

Referring to FIG. 15 and again to FIG. 14, actuation mechanism 200 is capable of both manual and automatic rocking motions from a neutral position (shown in FIG. 14) to a forward rocked position having right side support member 44' defining an angle alpha (a) with respect to rear cross member 48'. Angle $\alpha$ can be equal to or less than an angle of rotation of actuation mechanism 32 during manual rocking motion. In the forward rocked position shown, the seat back member, defined by the position of right side assembly 40', can be power rotated to the forward rocked position with the seat back member in the fully upright position and the leg rest assembly 202 positioned in the stowed position.

Figure 15:
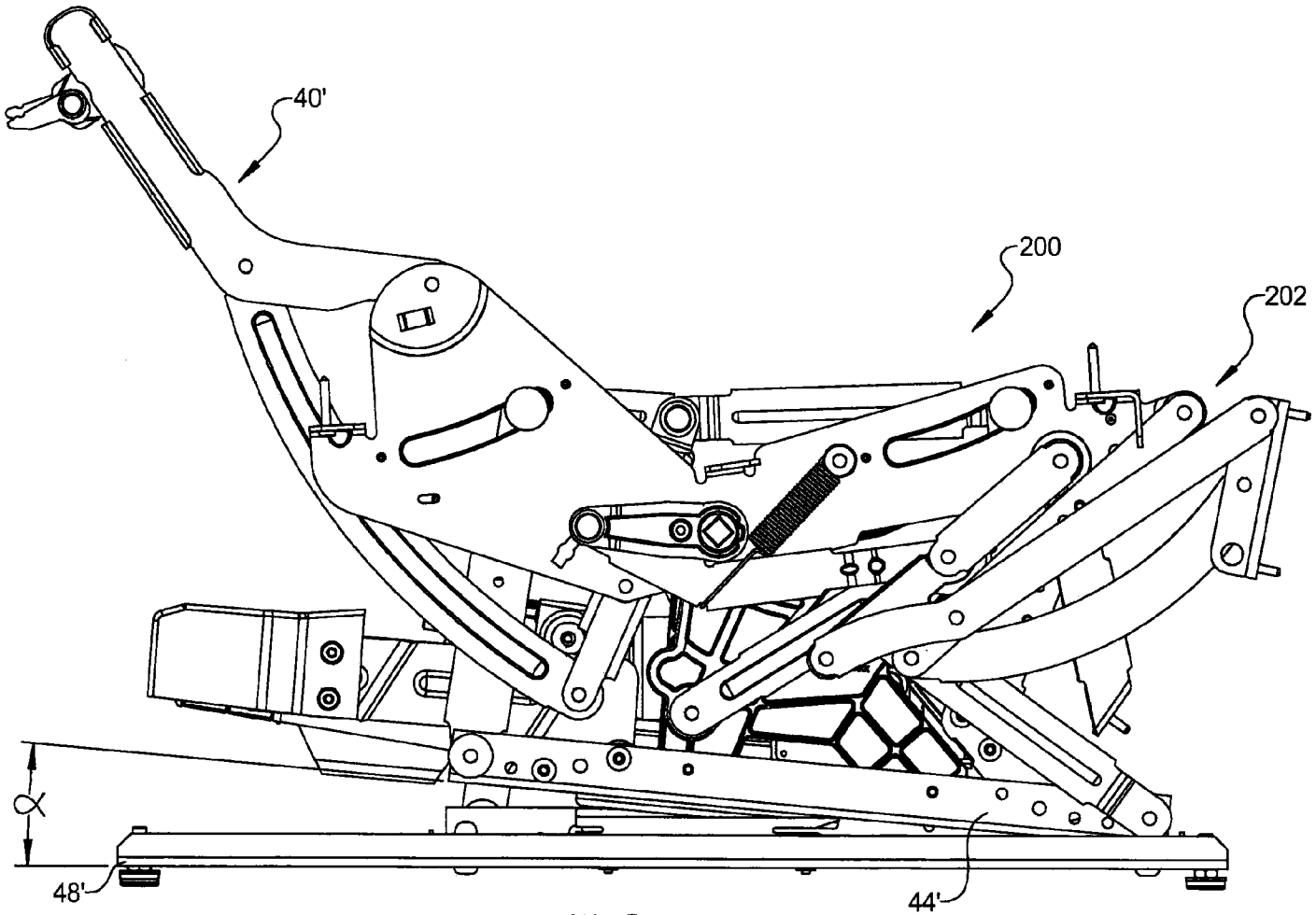
FIG. 15 is a right side elevational view of the furniture mechanism of FIG. 14 shown in a forward rocked position.
Figure 16:
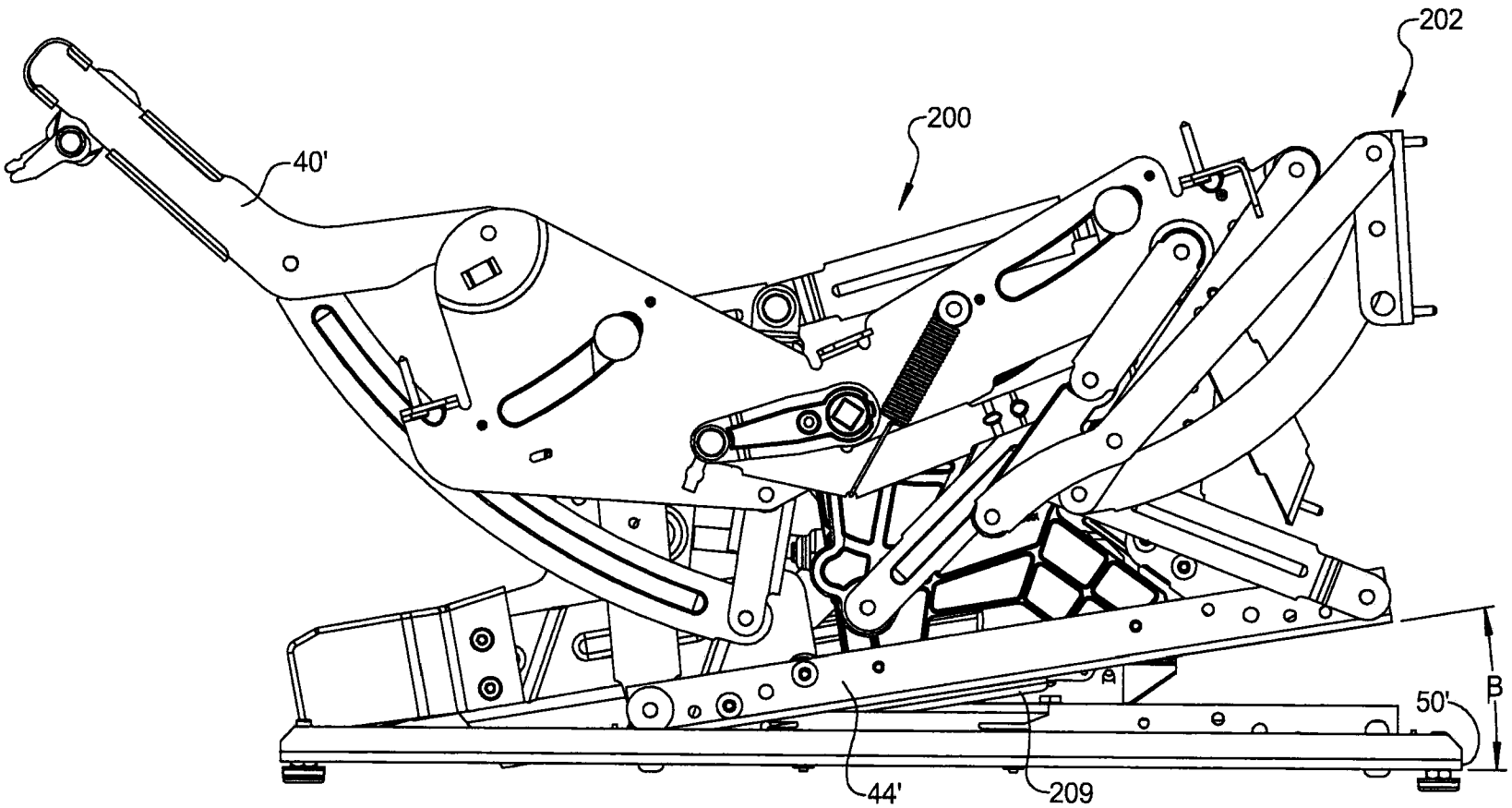
FIG. 16 is a right side elevational view of the furniture mechanism of FIG. 14 shown in a rearward rocked position.

Referring to FIG. 16 and again to FIG. 15, actuation mechanism 200 is shown in a rearward rocked position having right side support member 44' oriented at an angle beta ($\beta$) with respect to first cross member 50'. Angle $\beta$ can be equal to or less than rearward rocking angle of rotation of actuation mechanism 32 during manual rocking motion. According to several embodiments, actuation mechanism 200, having the leg rest assembly 202 in the stowed position, can also have the seat back member positioned in the fully reclined position, as shown with respect to right side assembly 40'. The fully reclined position for the seat back member can also be provided when actuation mechanism 200 is in the neutral or the forward rocked position. A device mounting member 209 releasably mounts the components of powered rocking drive device 208 (not clearly visible in this view).

Figure 17:
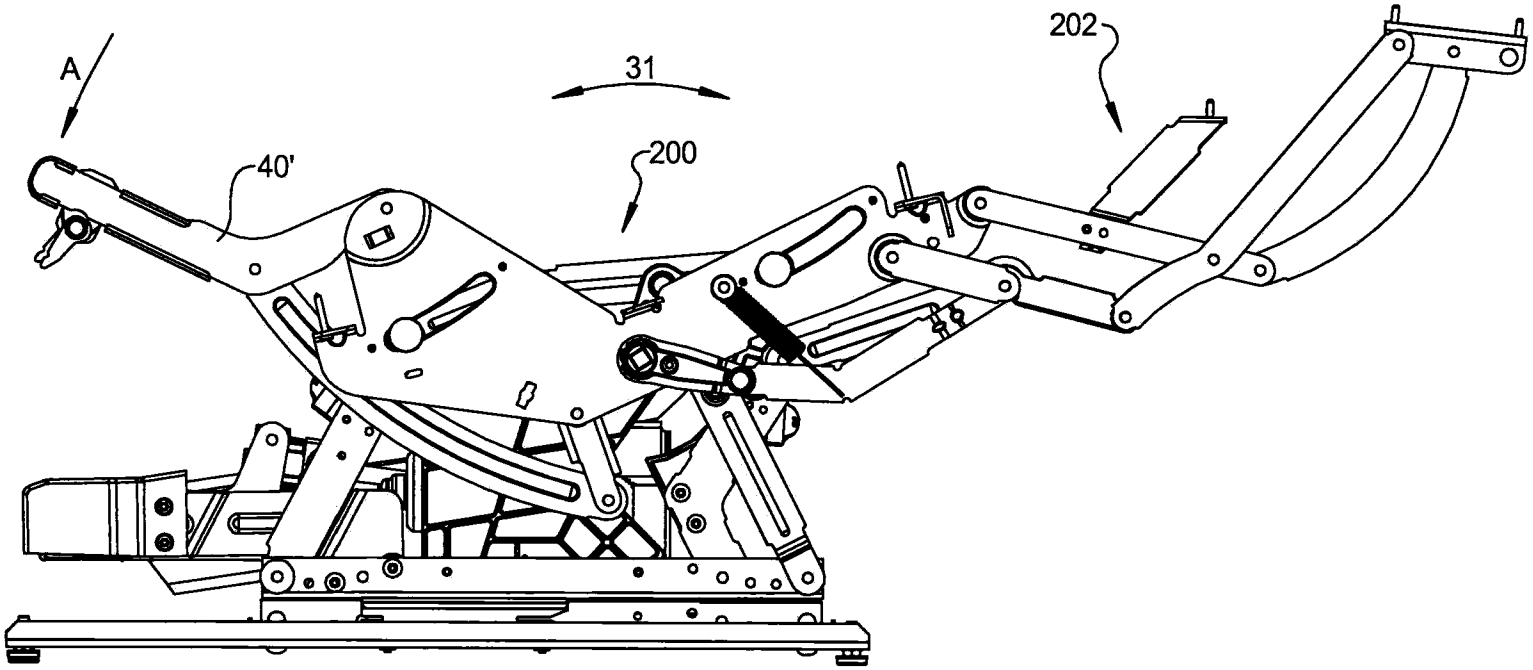
FIG. 17 is a right side elevational view of the furniture mechanism of FIG. 14 shown with a leg rest assembly in a fully extended position.

Referring to FIG. 17, in the neutral rocked position of actuation mechanism 200, the leg rest assembly 202 can also be positioned in the fully extended position shown. The seat back member represented by right side assembly 40' can be positioned in the fully reclined position by rotation in the seat back arc of rotation "A" at the same time that the leg rest assembly 202 is positioned in the fully extended position. Actuation mechanism 200 can be displaced from the neutral position shown by powered actuation in either of the forward or rearward rocking motions with respect to furniture member arc of rotation 31 without changing the position of either the seat back member or the leg rest assembly 202.

Figure 18:
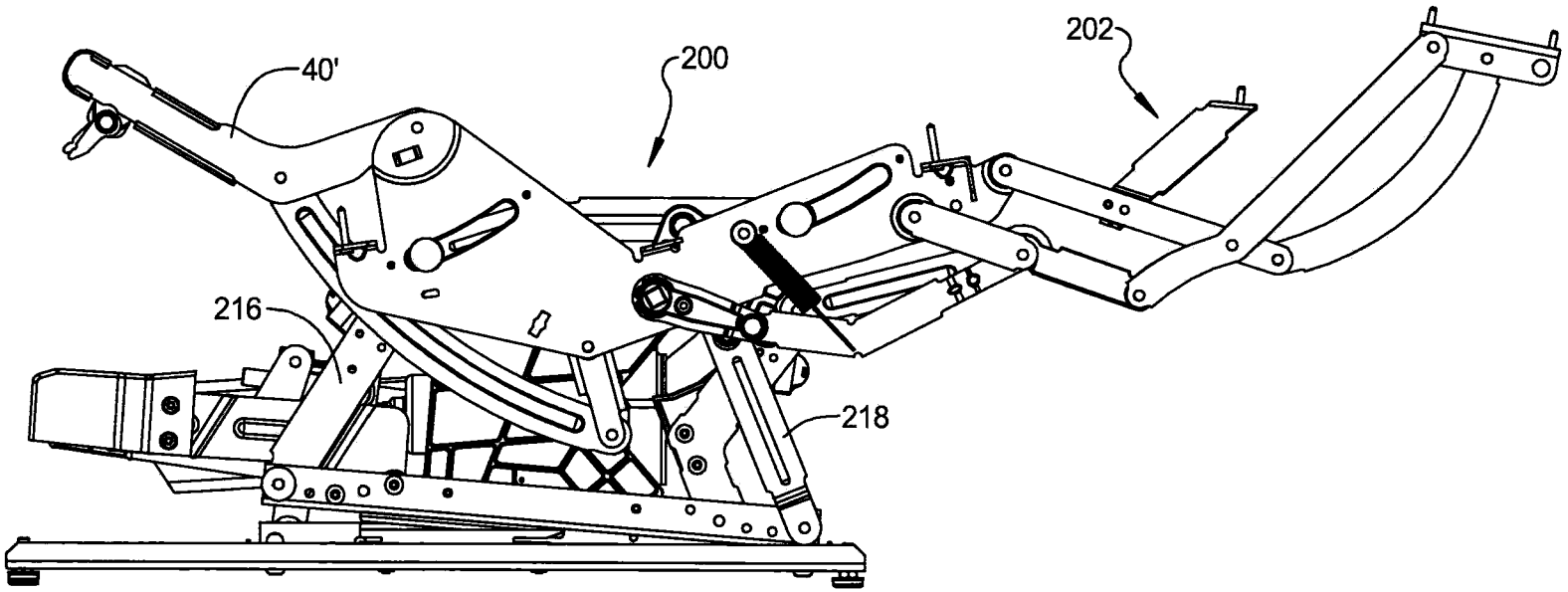
FIG. 18 is a right side elevational view of the furniture mechanism of FIG. 17 with the leg rest assembly in the fully extended position and in a forward rocked position.

Referring to FIG. 18, actuation mechanism 200 has the right side assembly 40' positioned in the seat back fully reclined position and the leg rest assembly 202 positioned in the fully extended position. Full automatic rocking of actuation mechanism 200 can occur in this or any seat back or leg rest assembly position of actuation mechanism 200.

Figure 19:
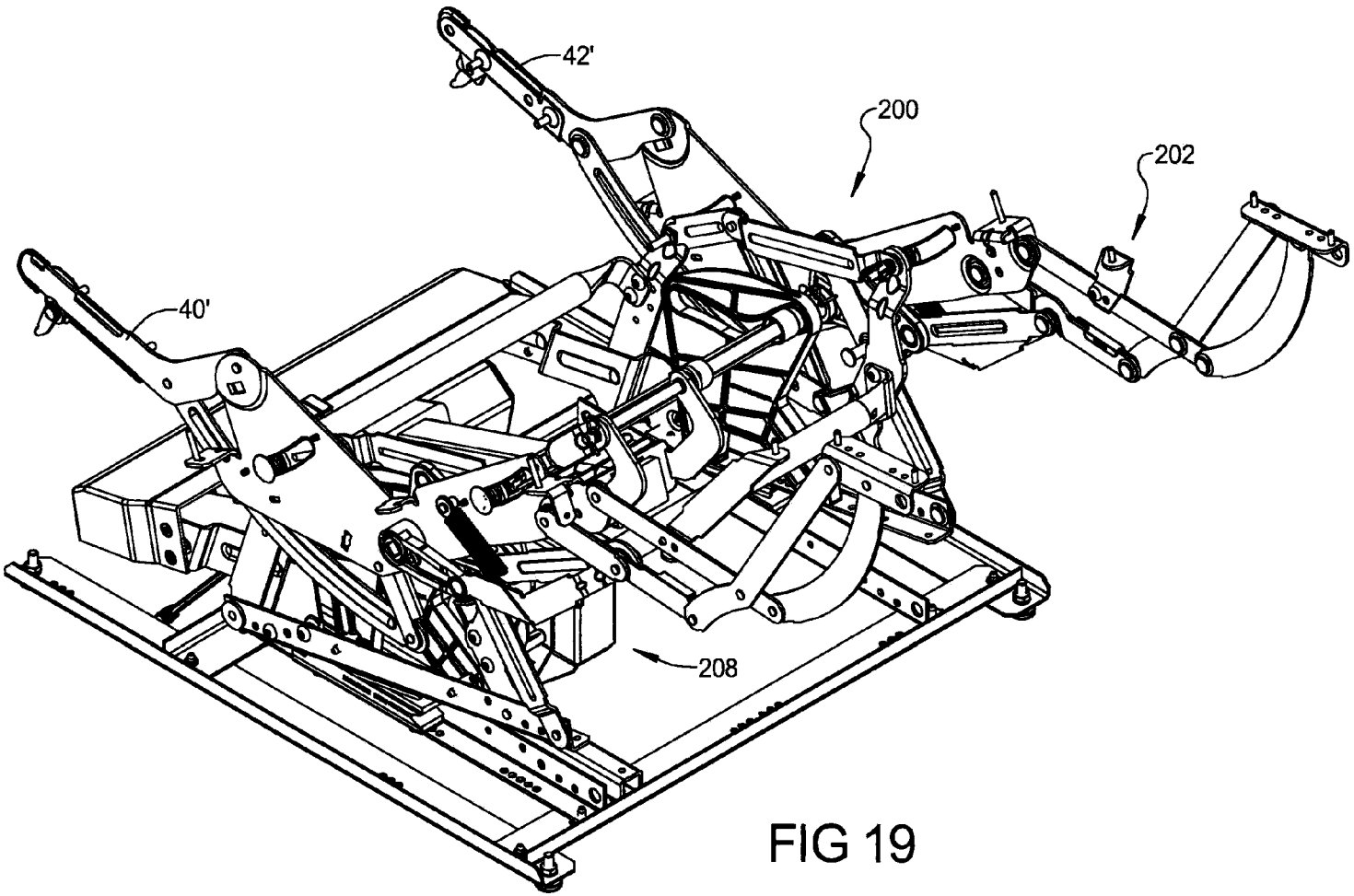
FIG. 19 is a right side top perspective view of the furniture mechanism of FIG. 17 with the leg rest assembly in the fully extended position and in a rearward rocked position.

Referring to FIG. 19, actuation mechanism 200 is shown after powered rocking motion to the rearward rocked position. Actuation mechanism 200 is also shown having right and left side assemblies 40', 42' positioned in the seat back fully reclined position and leg rest assembly 202 in the fully extended position, which are not effected by the rocked position of actuation mechanism 200. The automatic operation between any of the neutral, the forward, and the rearward rocked positions of actuation mechanism 200 is provided by operation of powered rocking drive device 208.

Figure 20:
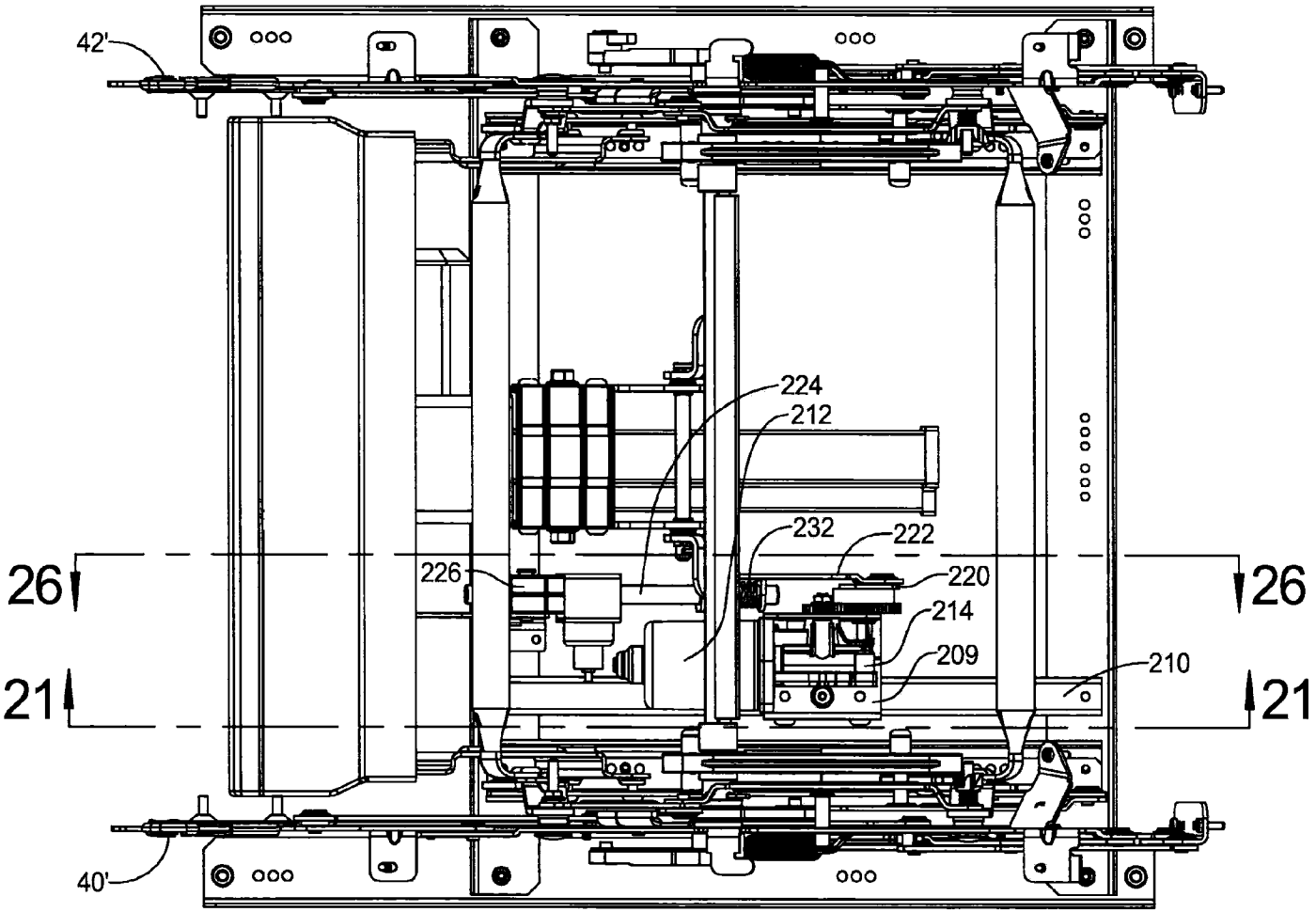
FIG. 20 is a top plan view of the furniture mechanism of FIG. 14.

Referring to FIG. 20, several of the components of powered rocking drive device 208 are fixedly connected to a longitudinal frame member 210 using device mounting member 209. These components include a rocking motion motor 212 which is connected to a source of electric power (not shown) such as a 110-volt AC outlet. Rocking motion motor 212 rotates to provide a driving force through a power transfer device 214 also fixedly connected to device mounting member 209. Rocking motion motor 212 and power transfer device 214 are fixedly connected to each other such that a rotating shaft of rocking motion motor 212 rotates components of power transfer device 214. Referring again to FIG. 18, according to several embodiments, rocking motion motor 212 and power transfer device 214 are positioned between rear and front rocking links 216, 218 provided on both right and left side assemblies 40', 42'.

Powered operation of rocking motion motor 212 rotates components such as gears of power transfer device 214, which in turn rotate a connecting link 220. Connecting link 220 is rotatably connected to a drive link 222. Drive link 222 is rotatably connected to and imparts a substantially forward and backward reciprocating motion to a drive shaft 224. A drive shaft engagement device 226 is slidably positioned on drive shaft 224 and can be releasably connected to drive shaft 224 to permit manual rocking motion of actuation mechanism 200. According to several embodiments the drive shaft engagement device 226 is provided in the form of a block assembly which is fastened together in sliding relationship with drive shaft 224. When powered automatic operation of actuation mechanism 200 is desired, block assembly 226 is releasably, mechanically coupled to a drive bearing 228 (shown and described in reference to FIG. 21). Drive bearing 228 is in turn rotatably connected to a cross support member 230 (shown and described in reference to FIG. 21) which is connected to right and left side assemblies 40', 42'. By rotating connecting link 220, which is connected through drive link 222, drive shaft 224, block assembly 226 and drive bearing 228 to cross support member 230 therefore provides a front-to-back reciprocating rocking motion of actuation mechanism 200. A shock absorber assembly 232 is used to connect drive link 222 to drive shaft 224. Shock absorber assembly 232 is provided to absorb the shock of coupling drive shaft 224 to drive bearing 228, which will be described in better detail in reference to FIG. 23.

Figure 21:
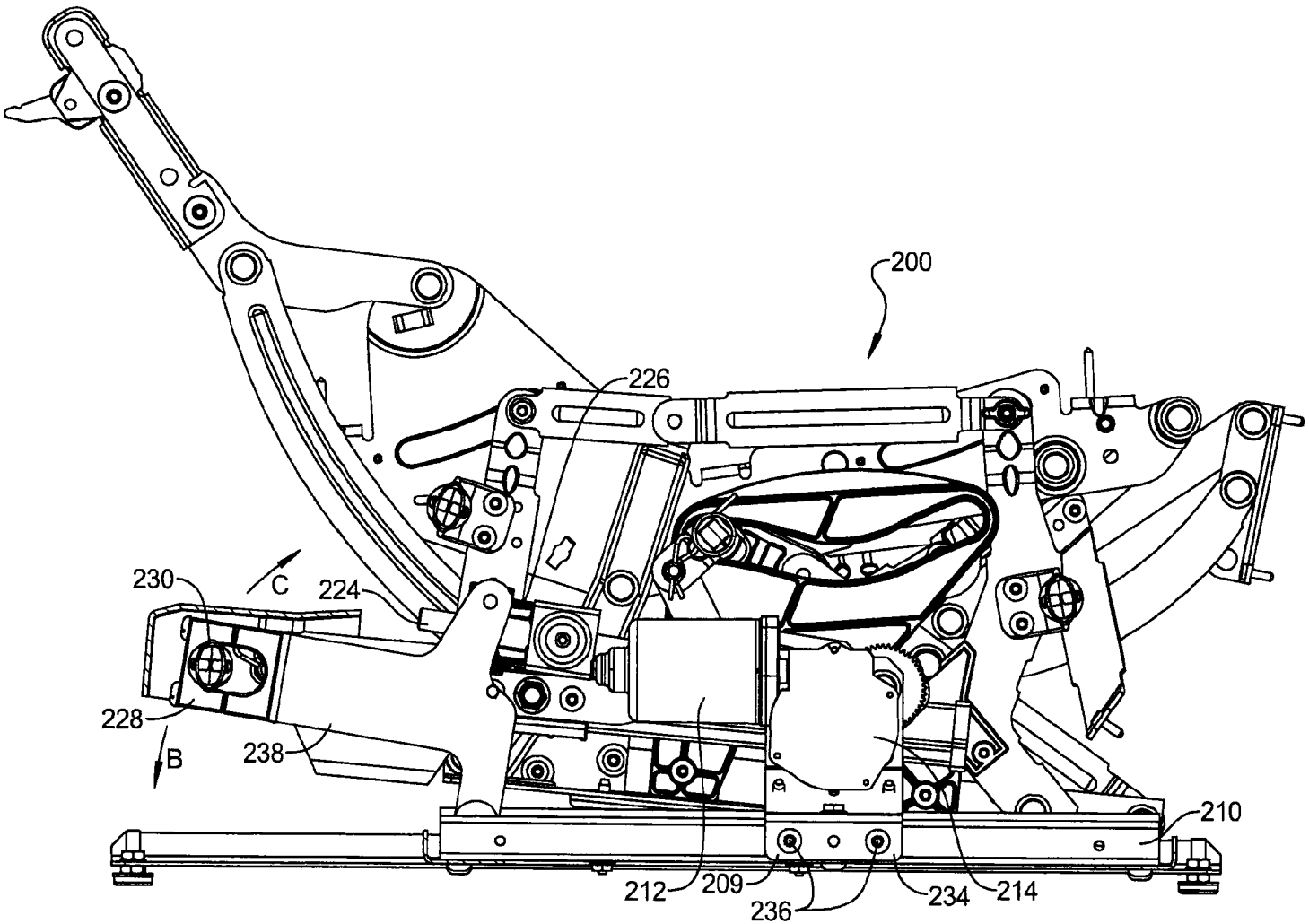
FIG. 21 is a partial cross sectional right side elevational view taken at section 21 of FIG. 20.

Referring to FIG. 21, a mounting bracket 234 of device mounting member 209 is used to fixedly connect device mounting member 209 to longitudinal frame member 210. A plurality of fasteners 236 can be used for this purpose. From the non-rocked or neutral rocked position shown, drive bearing 228, coupled to drive shaft 224, can rotate cross support member 230 in rearward and forward rocking motions defining either a rearward rocking arc of rotation "B" or an opposite forward rocking arc of rotation "C". A rocking arm 238 is rotatably connected to both longitudinal frame member 210 and to block assembly 226, and is connected for example by fasteners to drive bearing 228. Axial displacement of drive shaft 224 is therefore converted to a rotating motion of drive bearing 228 and thereby to cross support member 230. Automatic, powered rocking motion for actuation mechanism 200 is provided by powered actuation of rocking motion motor 212 which transfers rotational force through power transfer device 214 which is converted to axial displacement of drive shaft 224. Automatic powered rocking motion will continue as long as rocking motion motor 212 is energized. After rocking motion motor 212 is de-energized, actuation mechanism 200 returns, substantially by the force of gravity, to the neutral rocked position shown.

Figure 22:
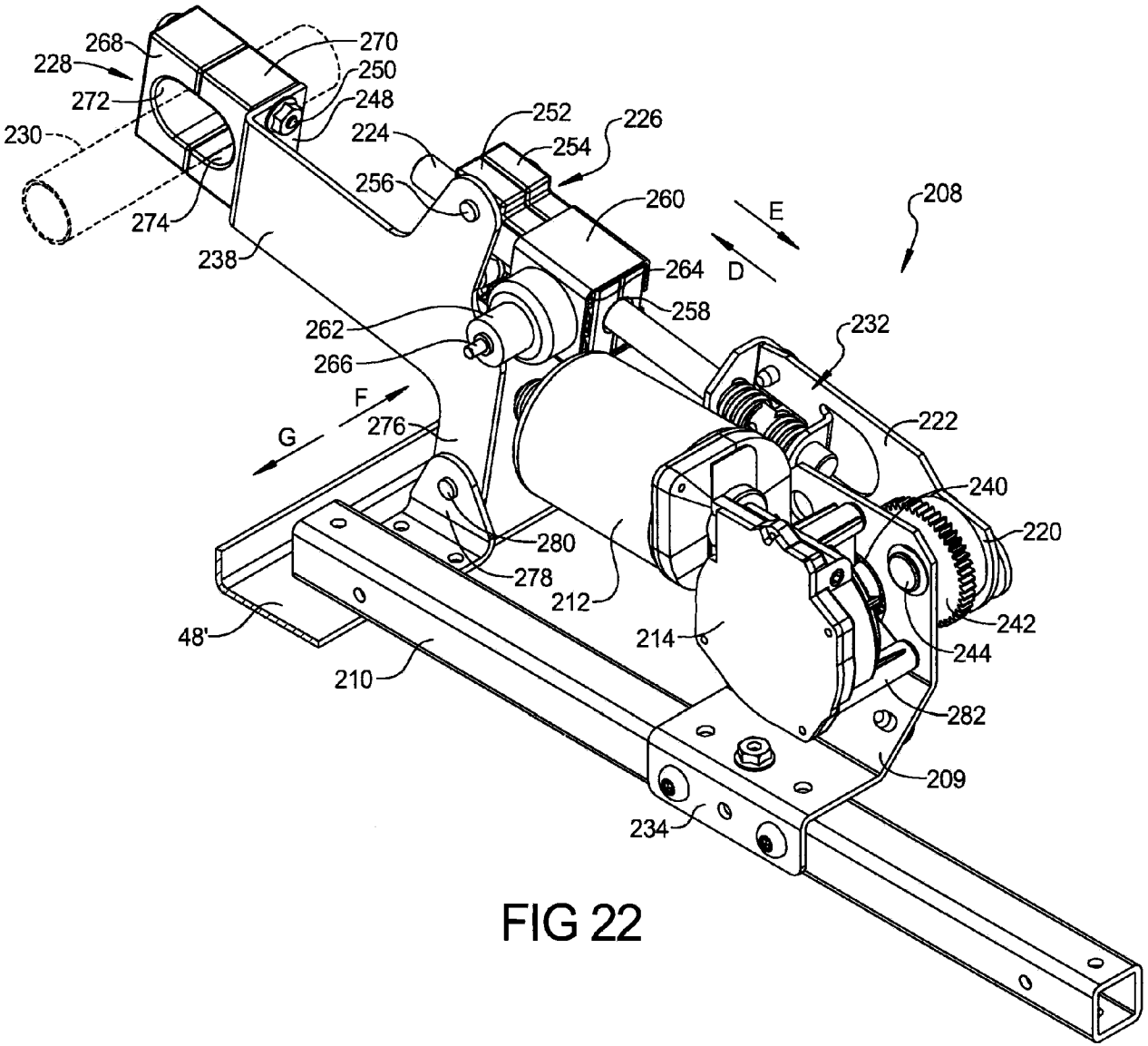
FIG. 22 is a front right perspective view of a powered rocking drive device for the furniture mechanism of FIG. 14.

Referring to FIG. 22, powered rocking drive device 208 can further include a drive gear 240, which is directly rotated by operation of power transfer device 214. Gear teeth of drive gear 240 are meshed with gear teeth of a reduction gear 242 and thereby rotate reduction gear 242. Reduction gear 242 is rotatably connected to device mounting member 209 using a reduction gear rotational fastener 244. Reduction gear 242 is directly connected to connecting link 220 by rotational fastener 244 such that rotation of reduction gear 242 co-rotates connecting link 220. Connecting link 220 is rotatably connected to drive link 222 using a connecting link rotational fastener 246 (shown in reference to FIG. 23).

Drive bearing 228 is releasably fixed to a flange portion 248 of rocking arm 238 using a plurality of fasteners 250. Rocking arm 238 is rotatably connected to each of a first block member 252 and a second block member 254 of block assembly 226 using a block rotational fastener 256 such that first and second block members 252, 254 are oppositely positioned with respect to drive shaft 224. Clearance is provided through an aperture defined between first and second block members 252, 254 such that drive shaft 224 can freely slide through block assembly 226 to permit manual rocking motion when powered rocking drive device 208 is not energized. Each of the first and second block members 252, 254 include a semi-circular bore 258 which align with each other on opposite sides of drive shaft 224. Semi-circular bore 258 has a diameter larger than a diameter of drive shaft 224 to allow free sliding motion of drive shaft 224 with respect to block assembly 226.

A solenoid bracket 260 connected to block assembly 226 is used to mount a solenoid 262. Fasteners 264 are used to connect solenoid bracket 260 to at least second block member 254. Solenoid 262 is therefore maintained at a fixed positioned with respect to block assembly 226. Solenoid 262 slidably displaces a pin 266 when energized or de-energized. When solenoid 262 is de-energized, sliding motion of drive shaft 224 in either of a drive shaft extending direction "D" or a driveshaft retracting direction "E" within semi-circular bores 258 can occur, permitting manual rocking motion of actuation mechanism 200. Pin 266, only partially visible in this view, is normally retracted away from engagement with drive shaft 224 when rocking motion motor 212 is non-operational or de-energized. Pin 266 is movable in each of a pin engagement direction "F" and a pin retraction direction "G". Pin 266 is moved in the pin engagement direction "F" when solenoid 262 is energized and is biased to move in the pin retraction direction "G" when solenoid 262 is de-energized.

Cross support member 230 is rotatably received through drive bearing 228. Drive bearing 228 includes each of a first bearing half 268 and a second bearing half 270 which are connected using bearing fasteners 250. Similar to first and second block members 252, 254, when joined together the first and second bearing halves 268, 270 create a cross support member receiving diameter or elongated slot 272 by opposed semi-circular ovals 274 created in each of the first and second bearing halves 268, 270. Elongated slot 272 is larger than a diameter of cross support member 230. This diameter difference or clearance permits rotation of drive bearing 228 with respect to cross support member 230. Rocking arm 238 includes a rocking arm portion 276 oppositely positioned with respect to flange portion 248. Rocking arm 238 is further rotatably connected at rocking arm portion 276 to a rocking arm mount bracket 278 using an arm mount rotational fastener 280. Rocking arm mount bracket 278 is connected for example using fasteners to rear cross member 48'.

According to several embodiments, extension posts 282 can be provided with power transfer device 214 to mount power transfer device 214 and rocking motion motor 212 to device mounting member 209. A length of extension posts 282 is predetermined to align the gear teeth of drive gear 240 with the corresponding gear teeth of reduction gear 242.

Figure 23:
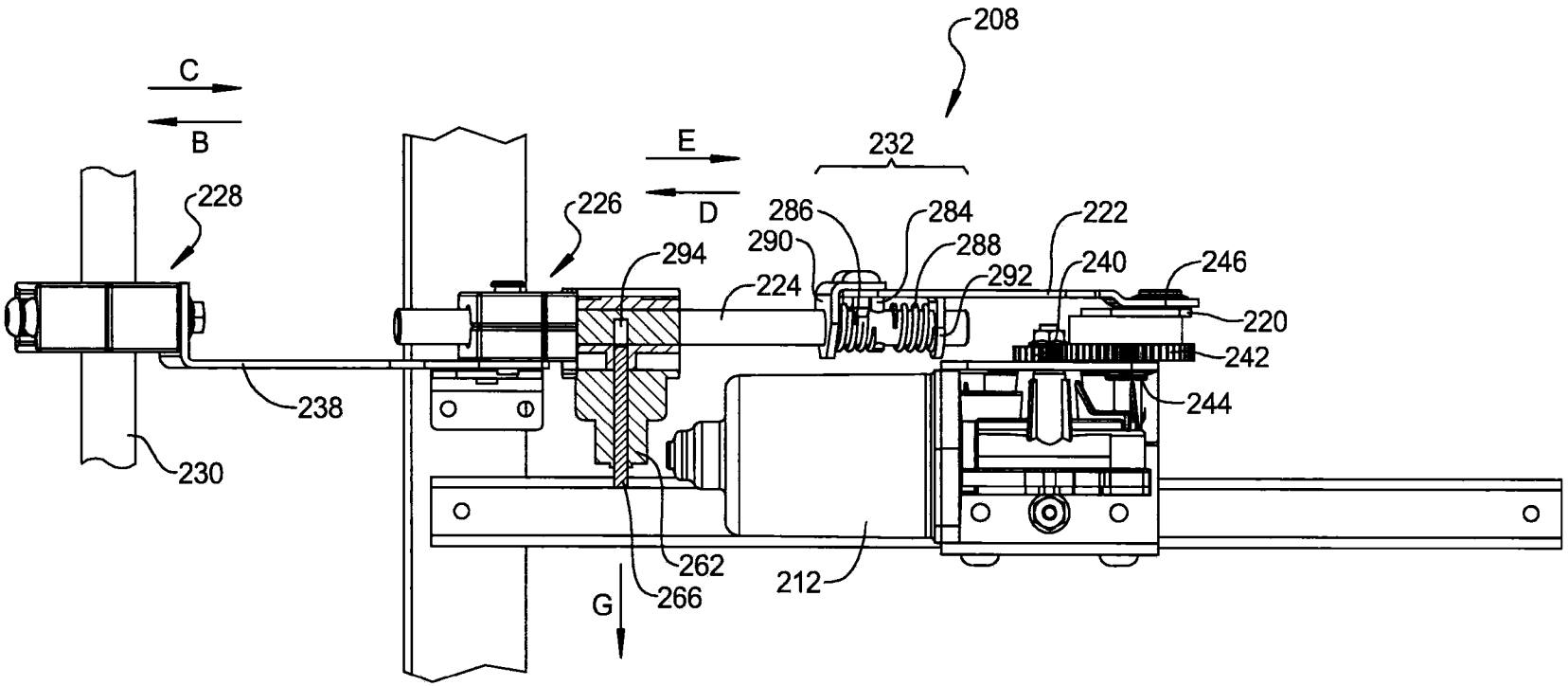
FIG. 23 is a top plan view of the powered rocking drive device of FIG. 22.

Referring to FIG. 23, as previously noted cross support member 230 will move in each of the rearward rocking arc of rotation "B" and the forward rocking arc of rotation "C" during rocking motion of the actuation mechanism 200. Drive bearing 228, rotatably coupled to cross support member 230 and rotatably coupled to block assembly 226, therefore move in unison with the motion of cross support member 230. This motion is permitted by a sliding motion of block assembly 226 with respect to drive shaft 224 during manual rocking motion of the actuation mechanism.

When powered rocking motion of actuation mechanism 200 is desired, rocking motion motor 212 and solenoid 262 are simultaneously energized. For powered rocking motion drive shaft 224 is releasably coupled to the block assembly 226. The drive force of rocking motion motor 212 is thereby transferred through drive shaft 224, block assembly 226 and rocking arm 238 to drive bearing 228 to displace cross support member 230. Because of the difference in masses involved, as well as the possibility that block assembly 226 may be in motion independent of the reciprocating motion of drive shaft 224 when rocking motion motor 212 is energized, the shock absorber assembly 232 is provided to elastically axially couple drive link 222 to drive shaft 224. This is accomplished using an assembly retention pin 284 which is perpendicularly received through drive shaft 224 and extends outwardly from drive shaft 224 on opposite sides. A first biasing member 286 slidably displaced on drive shaft 224 is positioned on a first side of assembly retention pin 284 and a second biasing member 288 also slidably displaced on drive shaft 224 is positioned on an opposite side of assembly retention pin 284.

A first retention member 290 retains first biasing member 286 such that first biasing member 286 elastically compresses between assembly retention pin 284 and first retention member 290 when drive shaft 224 is displaced in the drive shaft extending direction "D". A second retention member 292, extending from drive link 222, is provided to bound second biasing member 288 between assembly retention pin 284 and second retention member 292. Second biasing member 288 will elastically compress when drive shaft 224 moves in the drive shaft retraction direction "E". The compression of either first or second biasing members 286, 288 helps absorb the impact load when drive shaft 224 is coupled to drive bearing 228 using block assembly 226 and pin 266. According to several embodiments, first and second biasing members 286, 288 are provided as coiled compression springs having hollow center cavities slidably received over the diameter of drive shaft 224.

When solenoid 262 is de-energized, pin 266 is displaced away from, and therefore not engaged with drive shaft 224. At this time, pin 266 is spaced freely away from an aperture, bore or slot 294 created in drive shaft 224. This permits cross support member 230 to freely move in either of the rearward rocking arc of rotation "B" or forward rocking arc of rotation "C" by free sliding motion of block assembly 226 with respect to drive shaft 224. At the same time that solenoid 262 is de-energized, rocking motion motor 212 is also de-energized, permitting manual rocking motion of the actuation mechanism. During manual rocking motion there is no rotation of reduction gear 242, or connecting link 220 when manual rocking motion is occurring. Drive link 222 may swing about an axis of rotation defined by rotational fastener 246 due to rotation of rocking arm 238.

Figure 24:
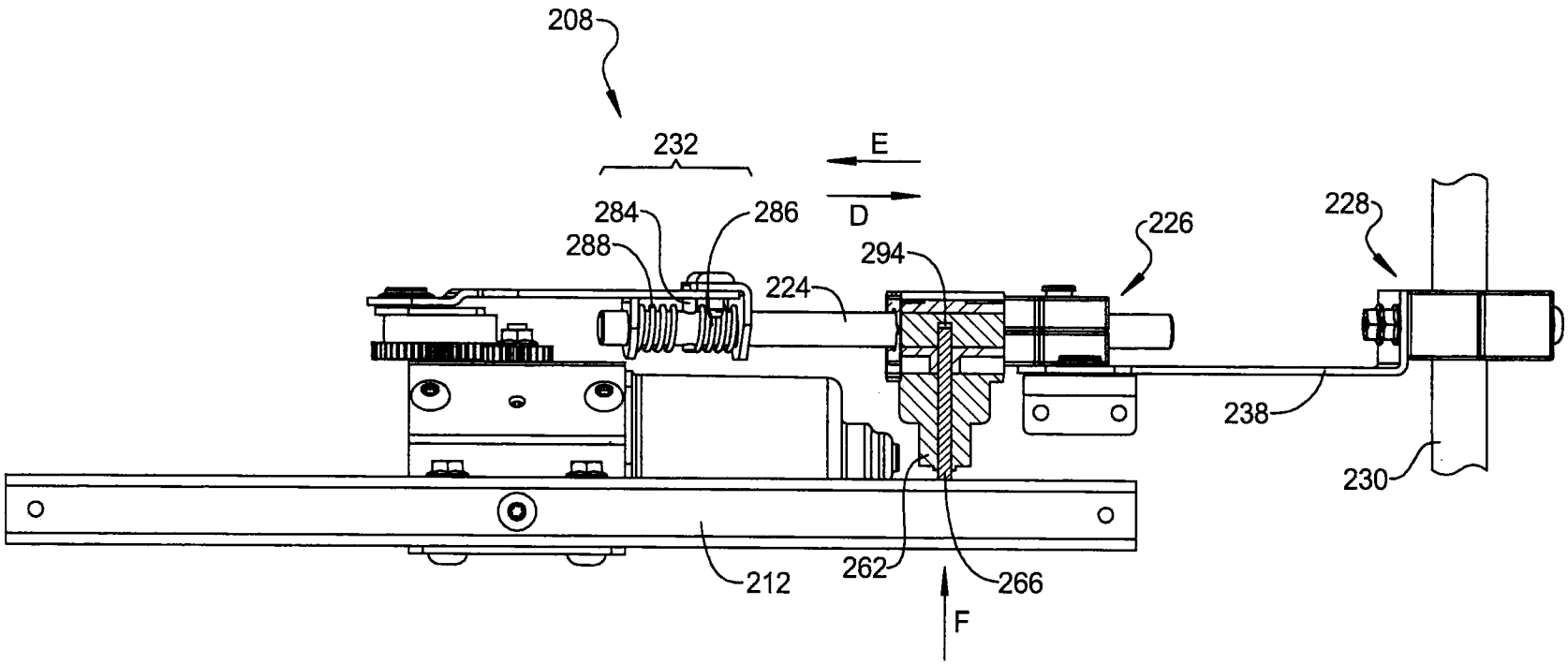
FIG. 24 is a bottom plan view of the powered rocking drive device of FIG. 22.

Referring to FIG. 24, when automatic/powered rocking operation of powered rocking drive device 208 is desired, both rocking motion motor 212 and solenoid 262 are simultaneously energized. When energized, solenoid 262 directs sliding displacement of pin 266 into sliding engagement with slot 294 of drive shaft 224. This transfers a drive shaft reciprocating motion in either of the drive shaft extending direction "D" or drive shaft retracting direction "E" of drive shaft 224 through rocking arm 238 and drive bearing 228 to cross support member 230. Because slot 294 may not initially be in direct axial alignment to receive pin 266, the shock absorber assembly 232 is provided such that when pin 266 engages slot 294, a coupling force or abrupt acceleration is partially absorbed by first and/or second biasing members 286, 288 against assembly retention pin 284 and is therefore not directly transferred through to the occupant of the furniture member.

When pin 266 engages slot 294, drive shaft 224 is coupled to drive bearing 228 for powered displacement of cross support member 230 in both of the rearward rocking arc of rotation "B" and forward rocking arc of rotation "C" as a reciprocating rocking motion. As long as solenoid 262 is energized, an extending force is provided by solenoid 262 to extend pin 266 in the pin engagement direction "F" to maintain the releasable coupling between drive shaft 224 and cross support member 230. Immediately when solenoid 262 is de-energized, pin 266 is biased to retract out of slot 294 and subsequently retracts away from slot 294, thereby ceasing the automatic powered rocking motion of the actuation mechanism by powered rocking drive device 208.

Figure 25:
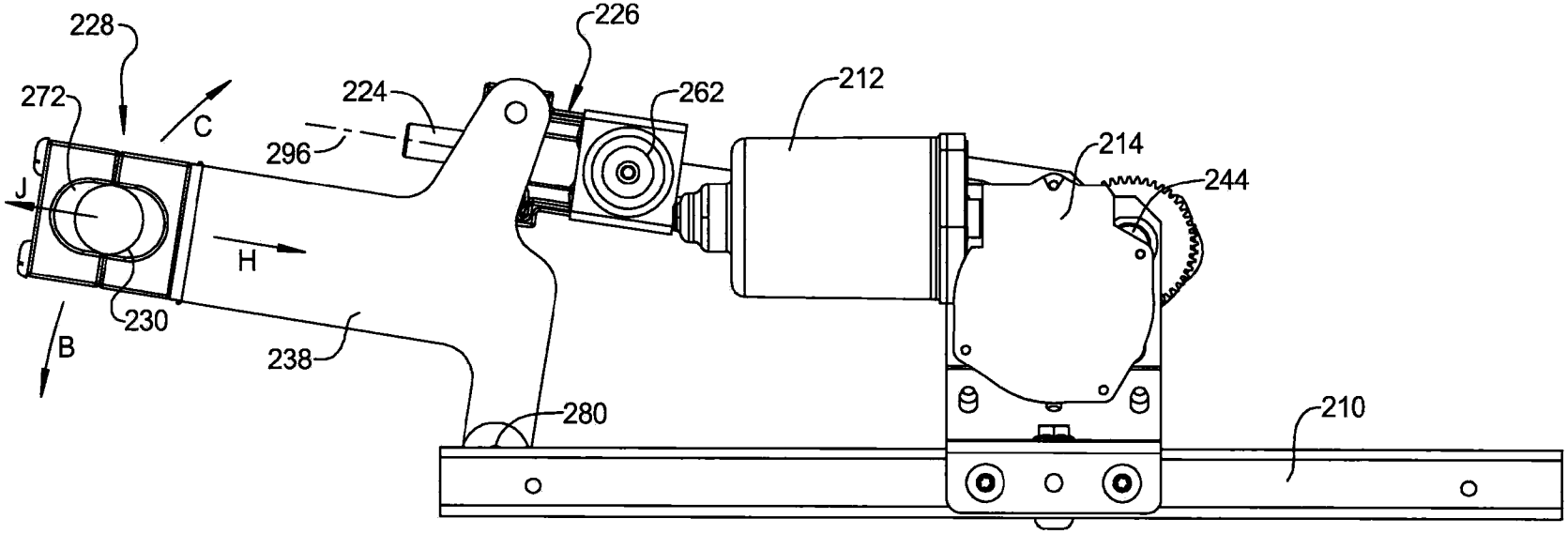
FIG. 25 is a right side elevational view of the powered rocking drive device of FIG. 22.

Referring to FIG. 25 and again to FIGS. 6 and 23, as previously noted, both the position and orientation of rocking motion motor 212 and power transfer device 214 are fixed with respect to longitudinal frame member 210. Because the axis of rotation of rotational fastener 244 is offset with respect to the axis of rotation of rotational fastener 246 shown in FIG. 23, a longitudinal axis 296 of drive shaft 224 can angularly change in addition to the front-to-back rocking reciprocating motion during powered automatic rocking operation. This can manifest itself in upward and downward motions of the drive bearing 228 in either the rearward rocking arc of rotation "B" or forward rocking arc of rotation "C" with respect to an axis of rotation defined by rotational fastener 280. Because the furniture member arc of rotation 31 can vary due to the amount and position of deflection of the rocking motion biasing member 118, to further allow for this variance cross support member 230 within elongated slot 272 can displace in either a first slot axial direction "H" or an opposite second slot axial direction "J".

Figure 26:
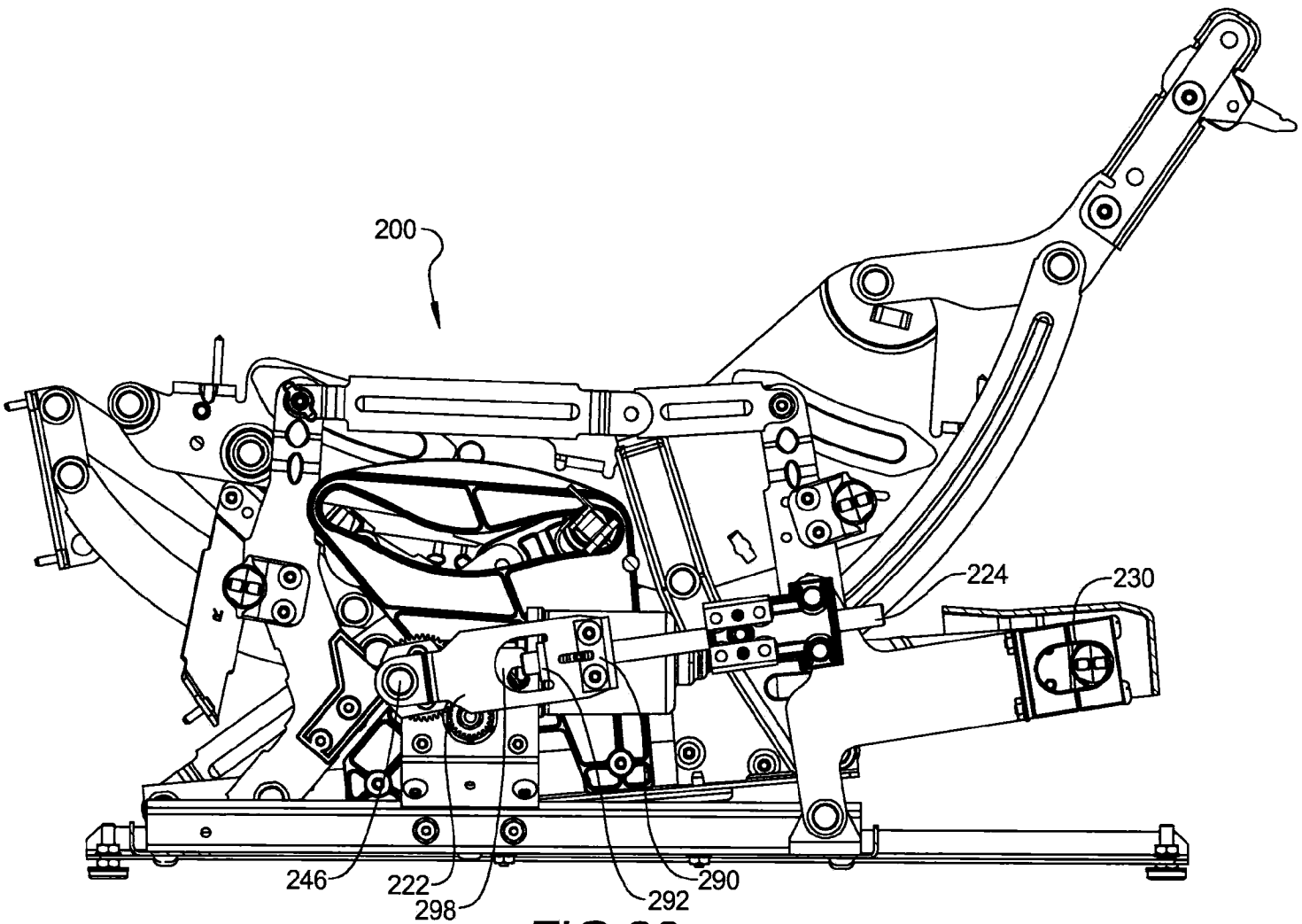
FIG. 26 is a partial cross sectional left side elevational view taken at section 26 of FIG. 20.

Referring to FIG. 26, according to several embodiments, second retention member 292 can be formed by a punching, piecing or similar operation on drive link 222 such that second retention member 292 is bent or formed at an angle with respect to drive link 222 thereby forming a cavity 298 in drive link 222 which provides access for a fastener. According to several embodiments, first retention member 290 is fastenably connected to drive link 222. Rotational fastener 244 is therefore oriented to provide an off-center drive force with respect to a longitudinal axis of cross support member 230.

Figure 27:
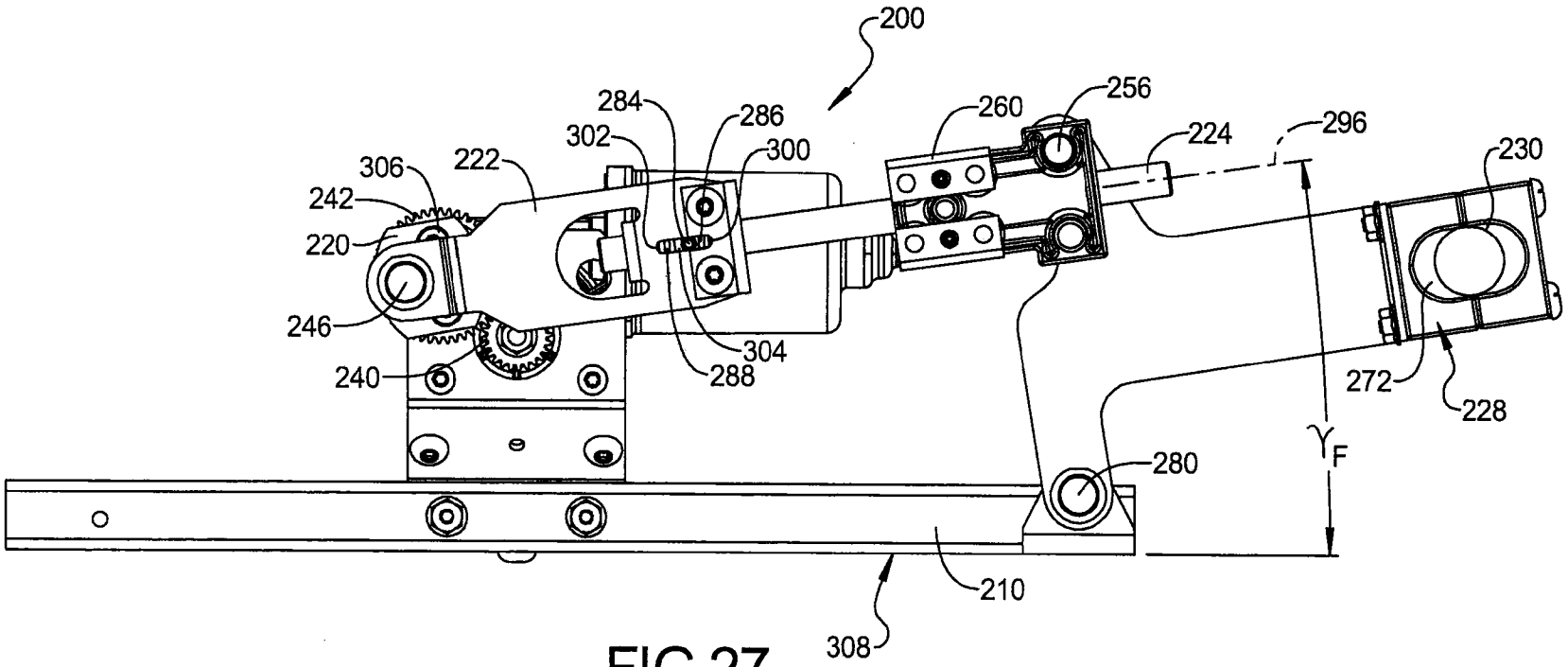
FIG. 27 is a left side elevational view of the powered rocking drive device of FIG. 22 in a forward rocked position.

Referring to FIG. 27, one or more fasteners 334 such as rivets can be used to fix first retention member 290 onto drive link 222. Opposed first and second end walls 300, 302 of an elongated pin travel slot 304 create positive stops for sliding travel of assembly retention pin 284 which is partially received in pin travel slot 304. Pin travel slot 304 can also extend partially through first retention member 290 as necessary. Opposed first and second end walls 300, 302 prevent over-compression of first and second biasing members 286, 288 as drive shaft 224 axially displaces during automatic powered operation of powered rocking drive device 208. At least one fastener 306 such as a bolt or rivet is used to fix connecting link 220 onto reduction gear 242 such that axial rotation of reduction gear 242 with respect to rotational fastener 244 co-rotates connecting link 220.

With continuing reference to FIG. 27, the furthest forward rocked position of powered rocking drive device 208 is created when longitudinal axis 296 of drive shaft 224 defines an angle gamma ($Y_F$) with respect to plane defined by a lower surface 308 of longitudinal frame member 210. At this position, angle $Y_F$ is at a maximum and reduction gear 242 has rotated connecting link 220 and thereby rotational fastener 246 such that rotational fastener 246 is located at a furthest forward position. This also displaces both drive link 222 and drive shaft 224 forward such that a central axis of rotation of rotational fastener 256 is positioned forward of a central axis of rotation of rotational fastener 280. Drive bearing 228 is thereby rotated to its highest elevation above lower surface 308.

Referring to FIG. 28 and again to FIGS. 14 and 27, the furthest rearward rocked position of powered rocking drive device 208 is created when longitudinal axis 296 of drive shaft 224 defines an angle gamma ($\gamma_R$) with respect to the plane defined by lower surface 308 of longitudinal frame member 210. At the rearward rocked position, angle $\gamma_R$ is less than angle $\gamma_F$ and at a minimum value, and reduction gear 242 has rotated connecting link 220 clockwise from its position shown in FIG. 27 and thereby also co-rotated rotational fastener 246 such that rotational fastener 246 is located at a furthest rearward position. This motion also displaces both drive link 222 and drive shaft 224 rearward such that the central axis of rotation of rotational fastener 256 is positioned rearward of the central axis of rotation of rotational fastener 280. Drive bearing 228 is thereby rotated to its lowest elevation above lower surface 308. It is therefore provided that drive shaft 224 not only displaces in the reciprocating front-to-back or forward-to-rearward motions but also displaces angularly with respect to lower surface 308 of longitudinal frame member 210 with the variation in angle gamma ($\gamma$). The change in angle gamma ($\gamma$) occurs without the reciprocating displacement of drive shaft 224 when both solenoid 262 and motor 212 are de-energized and occupant manual force is applied to create the rocking motion of actuation mechanism 200. This repeating angular motion of drive shaft 224 is permitted by a free sliding motion of block assembly 226 with respect to drive shaft 224 and the rotating motion of rocking arm 238.

Figure 28:
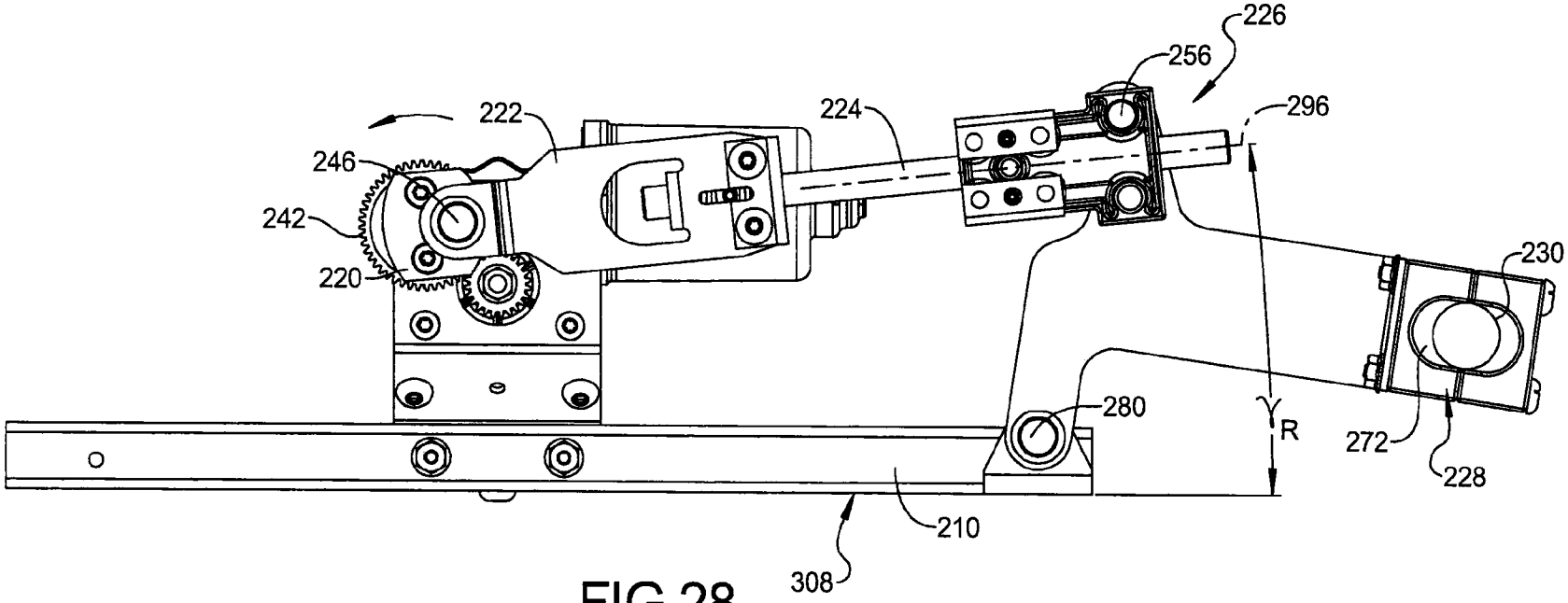
FIG. 28 is a left side elevational view of the powered rocking drive device of FIG. 22 in a rearward rocked position.
Figure 29:
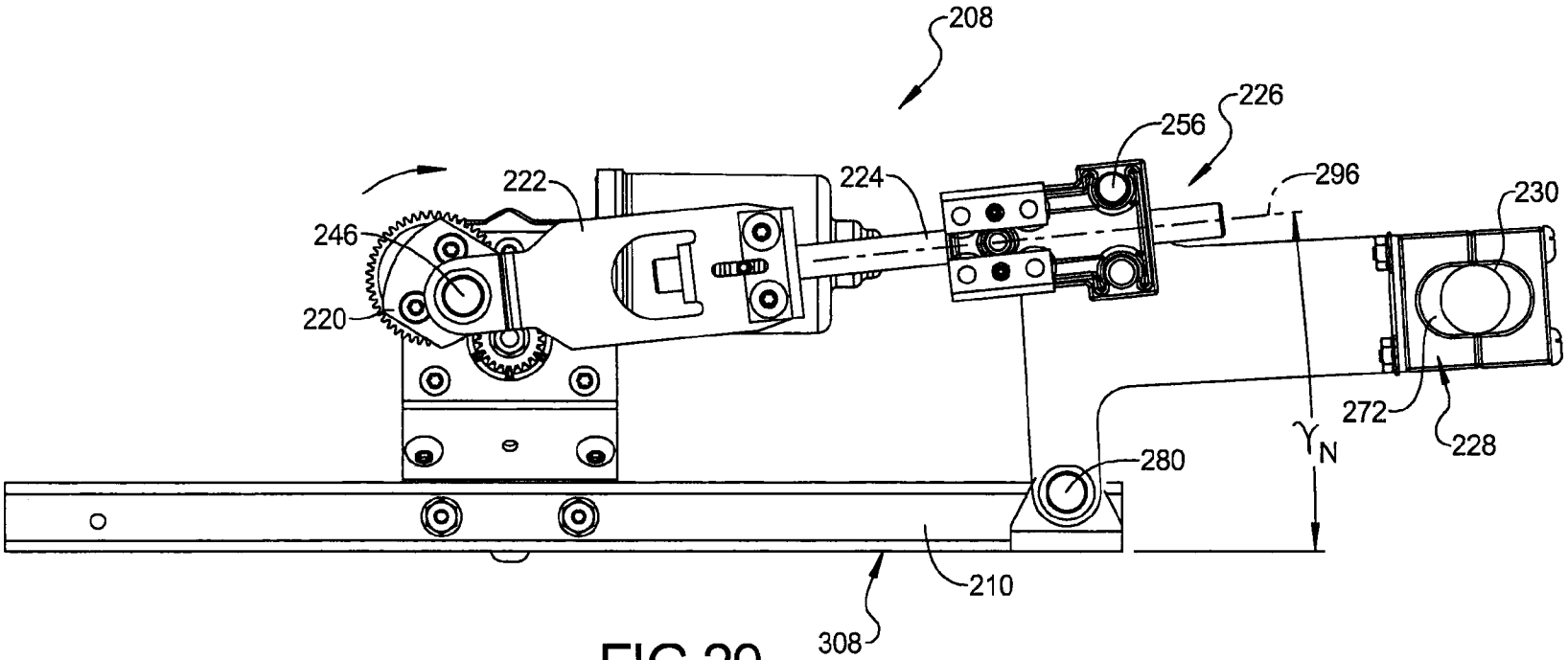
FIG. 29 is a left side elevational view of the powered rocking drive device of FIG. 22 in a neutral rocked position.

Referring to FIG. 29 and again to FIGS. 27 and 28, the neutral rocked position of powered rocking drive device 208 is created when longitudinal axis 296 of drive shaft 224 defines an angle gamma ($\gamma_N$) with respect to the plane defined by lower surface 308 of longitudinal frame member 210. At the neutral rocked position, angle $Y_N$ is less than angle $Y_F$ and greater than angle $\gamma_R$ and reduction gear 242 has rotated connecting link 220 counterclockwise from its position shown in FIG. 28 and thereby has also co-rotated rotational fastener 246 such that rotational fastener 246 is located at between the positions shown in FIGS. 27 and 28. This motion also displaces both drive link 222 and drive shaft 224 forward from the positions shown in FIG. 28. Drive bearing 228 is thereby rotated to a midpoint elevation above lower surface 308 with respect to FIGS. 27 and 28. According to several embodiments the motion of connecting link 220 and rotational fastener 246 do not provide 360 degree rotation, but are semi-circular to create a reciprocating front-to-back and return back-to-front motion of drive shaft 224.

Referring to FIGS. 1 and 14-29, when assembled for operation the furniture member 10 provided for powered rocking motion includes the frame 60' and the actuation mechanism 200 rotatably connected to the frame 60' by the rocking motion biasing member 118'. Electrically powered rocking drive device 208 includes motor 212 and drive shaft 224 connected to the motor 212 and releasably coupled to the actuation mechanism 200. The drive shaft 224 is moved in reciprocating forward and rearward directions "E", "D" by operation of the motor 212. Solenoid 262 is energized when the motor 212 is energized and de-energized when the motor 212 is de-energized. The solenoid 262 when de-energized decouples the drive shaft 224 from the actuation mechanism 200 permitting an occupant to induce forward and rearward rocking motions "C", "B" of the actuation mechanism 200 with respect to the frame 60'. The solenoid 262 when energized acts to releasably couple the drive shaft 224 to the actuation mechanism 200 such that operation of the motor 212 automatically induces the forward and rearward rocking motions "C", "B" of the actuation mechanism 200.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member having powered rocking motion, comprising:

a frame;

an actuation mechanism movably connected to the frame permitting actuation mechanism forward and rearward rocking motions;

a powered rocking drive device which when energized is releasably engaged to both the actuation mechanism and the frame to automatically induce the forward and rearward rocking motions of the actuation mechanism;

a rocking motion motor connected to and operating a power transfer device; and a solenoid simultaneously energized when the motor is energized and de-energized when the motor is de-energized.

2. The furniture member of claim 1, further including:

a drive shaft connected to the power transfer device, the drive shaft capable of reciprocating movement in at least forward and rearward reciprocating directions when the motor is energized; and a pin movable by the solenoid when the solenoid is energized to engage a slot created in the drive shaft.

3. The furniture member of claim 2, further including:

a cross support member connected to first and second longitudinal frame members of the actuation mechanism; and a drive bearing releasably engaged to the drive shaft when the pin is engaged in the slot, the drive bearing rotatably connected to the cross support member such that the reciprocating movement of the drive shaft successively moves the actuation mechanism in the forward and rearward rocking motions.

4. The furniture member of claim 2, further including a shock absorber assembly having first and second biasing members slidably disposed on the drive shaft and oppositely positioned about a connecting pin extending through the drive shaft, the first biasing member elastically compressed when the drive shaft moves in the forward direction and the second biasing member elastically compressed when the drive shaft moves in the rearward direction.

5. The furniture member of claim 2, further including:

a drive gear of the power transfer device connected to the motor, the drive gear engaged to a reduction gear;

a connecting link directly connected to the reduction gear; and a drive link connecting the connecting link to the drive shaft.

6. The furniture member of claim 1, further including:

a drive shaft connected to the power transfer device and movable in at least a forward and a rearward direction defining a reciprocating movement;

a drive shaft engagement device selectively engaged to the drive shaft; and a rocking arm rotatably connected to each of the drive shaft engagement device and the frame such that the reciprocating movement of the drive shaft rotates the rocking arm when the drive shaft engagement device is engaged to the drive shaft.

7. The furniture member of claim 6, further including:

a cross support member connected to first and second longitudinal frame members of the actuation mechanism; and a drive bearing connected to the rocking arm and rotatably connected to the cross support member such that the reciprocating motion of the drive shaft successively moves the actuation mechanism in the forward and rearward rocking motions.

8. The furniture member of claim 6, wherein when the solenoid is de-energized the pin is at a disengaged position displaced away from the slot, and the drive shaft engagement device is freely slidable on the drive shaft permitting an occupant to manually displace the actuation mechanism in the forward and rearward rocking motions.

9. The furniture member of claim 1, further including:

a drive shaft connected to the power transfer device;

a connecting pin received through the drive shaft; and a shock absorber assembly having a first biasing member slidably disposed on the drive shaft and a first flange slidably receiving the drive shaft, the first biasing member positioned between the connecting pin and the first flange and elastically compressed when the drive shaft moves in a first direction.

10. The furniture member of claim 9, further including:

a second flange connected to a drive link connected between the drive shaft and the power transfer device, the second flange slidably receiving the drive shaft and oppositely positioned about the connecting pin with respect to the first flange; and a second biasing member slidably received on the drive shaft between the second flange and the connecting pin, the second biasing member elastically compressed when the drive shaft moves in a second opposite to the first direction.

11. The furniture member of claim 1, further including:

a leg rest assembly connected to the actuation mechanism and displaceable between a stowed position and a fully extended position;

a seat back member connected to the actuation mechanism and displaceable between a fully upright position and a fully reclined position;

wherein the forward and rearward rocking motions are available in any combination of (a) the leg rest assembly in the stowed position and the seat back member in the fully upright position, (b) the leg rest assembly in the fully extended position and the seat back member in the fully upright position, or (c) the seat back member in the fully reclined position and the seat back member in the fully reclined position.

12. The furniture member of claim 1, wherein the actuation mechanism further includes:

a longitudinal frame member; and a device mounting member connecting the powered rocking drive assembly to the longitudinal frame member.

13. A furniture member having powered rocking motion, comprising:

a frame;

an actuation mechanism rotatably connected to the frame and movable in forward and rearward rocking motions with respect to the frame; and a powered rocking drive device having a motor connected to the actuation mechanism and a solenoid, the solenoid when energized releasably coupling the motor to the frame such that operation of the motor automatically induces the forward and rearward rocking motions of the actuation mechanism, the solenoid when de-energized decoupling the motor from the frame permitting an occupant to induce the forward and rearward rocking motions of the actuation mechanism with respect to the frame.

14. The furniture member of claim 13, further including:

a power transfer device connected to the motor; and a drive shaft connected to the power transfer device and movable in at least reciprocating forward and rearward directions when the motor is energized.

15. The furniture member of claim 14, further including:

a drive shaft engagement device slidably disposed on the drive shaft when the solenoid is de-energized; and a pin movable by the solenoid when the solenoid is energized to engage a slot created in the drive shaft to couple the drive shaft to the drive shaft engagement device.

16. The furniture member of claim 15, further including a rocking arm rotatably connected to each of the drive shaft engagement device and the frame.

17. The furniture member of claim 16, further including:

a cross support member fixedly connected to first and second longitudinal frame members of the actuation mechanism; and a drive bearing connected to the rocking arm and rotatably connected to the cross support member such that drive shaft movement in the reciprocating forward and rearward directions successively moves the actuation mechanism in the forward and rearward rocking motions.

18. The furniture member of claim 14, further including:

a cross support member fixedly connected to first and second longitudinal frame members of the actuation mechanism; and a drive bearing rotatably connected to the cross support member wherein drive shaft movement in the reciprocating forward and rearward directions successively moves the actuation mechanism in the forward and rearward rocking motions.

19. The furniture member of claim 14, wherein the drive device further includes:

a drive gear rotatably connected to the power transfer device;

a reduction gear rotated by the drive gear;

a connecting link co-rotated during rotation of the reduction gear; and a drive link rotatably connected to the connecting link and further connected to the drive shaft such that rotation of the drive gear induces the drive shaft to move in the reciprocating forward and rearward directions.

20. The furniture member of claim 14, further including a shock absorber assembly having first and second biasing members slidably disposed on the drive shaft and oppositely positioned about a connecting pin extending through the drive shaft, the first biasing member elastically compressed when the drive shaft moves in the forward direction and the second biasing member elastically compressed when the drive shaft moves in the rearward direction.

21. A furniture member having powered rocking motion, comprising:

a frame;

an actuation mechanism rotatably connected to the frame by a rocking motion biasing member;

an electrically powered rocking drive device, including:

a motor;

a drive shaft connected to the motor and releasably coupled to the actuation mechanism, the drive shaft moved in reciprocating forward and rearward directions by operation of the motor; and a solenoid energized when the motor is energized and de-energized when the motor is de-energized, the solenoid when de-energized decoupling the drive shaft from the actuation mechanism permitting an occupant to induce forward and rearward rocking motions of the actuation mechanism with respect to the frame, and when energized acts to releasably couple the drive shaft to the actuation mechanism such that operation of the motor automatically induces the forward and rearward rocking motions of the actuation mechanism.

22. The furniture member of claim 21, further including a drive shaft engagement device slidably disposed on the drive shaft when the solenoid is de-energized and releasably coupled to the drive shaft when the solenoid is energized.

23. The furniture member of claim 22, further including a rocking arm rotatably connected to each of the drive shaft engagement device and the frame such that the drive shaft moving in the reciprocating forward and rearward directions rotates the rocking arm.

24. The furniture member of claim 23, further including:

a cross support member fixedly connected to first and second longitudinal frame members of the actuation mechanism; and a drive bearing connected to the rocking arm and rotatably connected to the cross support member such that the reciprocal displacement of the drive shaft successively moves the actuation mechanism in the forward and rearward rocking motions.

25. The furniture member of claim 21, further including a pin movable by the solenoid when the solenoid is energized to engage a slot created in the drive shaft to releasably couple the drive shaft to the actuation mechanism.

26. The furniture member of claim 24, further including a drive shaft engagement device slidably disposed on the drive shaft when the solenoid is de-energized, the pin when the solenoid is de-energized positioned at a disengaged position displaced away from the slot.

27. The furniture member of claim 21, further including a shock absorber assembly having first and second compression spring biasing members slidably disposed on the drive shaft and oppositely positioned about a connecting pin extending through the drive shaft, the first biasing member elastically compressed when the drive shaft moves in the forward direction and the second biasing member elastically compressed when the drive shaft moves in the rearward direction.

* * * * *